United States Patent [19]

Sato et al.

[11] Patent Number: 4,845,018

[45] **Date of Patent: * Jul. 4, 1989**

[54] IMAGE-FORMING PROCESS INVOLVING HEATING STEP

[75] Inventors: Kozo Sato; Hiroshi Kitaguchi; Masashi Takeuchi; Masaaki Tsukase; Masatoshi Kato, all of Kanagawa, Japan

[73] Assignee: Fuji Photo Film, Co., Ltd., Kanagawa, Japan

[ * ] Notice: The portion of the term of this patent subsequent to Jan. 27, 2004 has been disclaimed.

[21] Appl. No.: 830,031

[22] Filed: Feb. 18, 1986

[30] Foreign Application Priority Data

Feb. 18, 1985 [JP] Japan ..... 60-29892

[51] Int. Cl.[4] ..... G03C 5/54; G03C 1/34

[52] U.S. Cl. ..... 430/203; 430/353; 430/611; 430/617; 430/619; 430/957; 430/960

[58] Field of Search ..... 430/617, 619, 353, 203, 430/955, 957, 958, 959, 960, 611

[56] References Cited

U.S. PATENT DOCUMENTS

| | | | |
|---|---|---|---|
| 3,960,566 | 6/1976 | Ikenoue et al. | 430/353 |
| 4,500,634 | 2/1985 | Sakanoue et al. | 430/957 |
| 4,618,571 | 10/1986 | Ichijima et al. | 430/553 |
| 4,639,408 | 1/1987 | Kitaguchi et al. | 430/619 |
| 4,678,735 | 7/1987 | Kitaguchi et al. | 430/203 |
| 4,678,739 | 7/1987 | Kitaguchi et al. | 430/353 |

FOREIGN PATENT DOCUMENTS

| | | | |
|---|---|---|---|
| 0244947 | 12/1985 | Japan | 430/203 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

An image-forming process involving a heating step is disclosed, which comprises conducting the heating in the presence of a compound represented by the following general formula (I):

(I)

wherein:

$R^1$ and $R^2$, which may be the same or different, each represents a group selected from an aryl group, a substituted aryl group, a heterocyclic group, and a substituted heterocyclic group;

$R^3$ represents a hydrogen atom, an alkyl group, a substituted alkyl group, a cycloalkyl group, a substituted cycloalkyl group, an aralkyl group, a substituted aralkyl group, or a group selected from those which are referred to with respect to $R^1$ and $R^2$;

$R^1$, $R^2$, and $R^3$ may form a ring structure via a hydrocarbon chain, a hetero atom-containing hydrocarbon chain or a hetero atom, or may be directly bound to each other to form a ring structure; and PUG represents a photographically useful group.

12 Claims, No Drawings

IMAGE-FORMING PROCESS INVOLVING HEATING STEP

FIELD OF THE INVENTION

This invention relates to an image-forming process involving a heating step and, more particularly, to an image-forming process involving a heating step using a precursor of a photographically useful reagent.

BACKGROUND OF THE INVENTION

Heretofore, a photographic process using silver halide has most widely been practiced, since it provides excellent sensitivity, gradation, and like photographic properties as compared with, for example, an electrophotographic process and a diazo type photographic process. In recent years, techniques have been developed which provide images easily in a short time by employing, as photographic processing of forming images on light-sensitive materials using silver halide, a dry processing involving heating in place of the conventional wet processing involving development in a developing solution.

Thermally developable light-sensitive materials are known in the art, and the thermally developable light-sensitive materials and the process thereof are described in, for example, "Shashin Kagaku no Kiso", pp. 553–555 (published by Corona Co., Ltd.), "Elizo Joho", Apr. 1978, p. 40, "Nebletts Handbook of Photography and Reprography", 7th Ed. (Van Norstrand Reinhold Company), pp. 32–33, U.S. Pat. Nos. 3,152,904, 3,301,678, 3,392,020, 3,457,075, British Pat. Nos. 1,131,108, 1,167,777, and Research Disclosure, June, 1978, pp. 9–15 (RD-17029).

Many processes have been proposed for obtaining color images. As to a process of forming color images by binding an oxidation product of a developing agent with a coupler, U.S. Pat. No. 3,531,286 proposes p-phenylenediamine type reducing agents and phenolic or active methylene couplers, U.S. Pat. No. 3,761,270 proposes p-aminophenol type reducing agents, Belgian Pat. No. 802,519 and Research Disclosure, the September issue of 1975, pp. 31 and 32 propose sulfonamidophenol type reducing agents, and U.S. Pat. No. 4,021,240 proposes a combination of sulfonamidophenol type reducing agents and 4-equivalent couplers.

As to the process of forming positive color images by a light-sensitive silver-dye bleach process, useful dyes and bleaching processes are described in, for example, Research Disclosure, the April issue of 1976, pp. 30–32 (RD-14433), ibid., the December issue of 1976, pp. 14–15 (RD-15227), U.S. Pat. No. 4,235,957, etc.

Further, an image-forming process by thermal development utilizing compounds which possess a previously formed dye moiety and which can release a mobile dye as a direct or inverse function of the reduction reaction of silver halide to silver at elevated temperatures is disclosed in European Patent Laid-Open Nos. 76,492 and 79,056, and Japanese Patent Application (OPI) Nos. 28,928/83 and 26, 008/83 (The term "OPI" as used herein refers to a "published unexamined Japanese patent application").

In addition, U.S. Pat. Nos. 4,500,626, 4,483,914, U.S. patent application Ser. No. 509,592 (filed on March 16, 1984), etc. describe the process of transferring a mobile dye imagewise formed by thermal development to an image-receiving layer by heating, and the image-receiving materials for the process. On the other hand, however, since the necessary photographic reagents are not expected to be fed from a developing solution or the like, all the photographic reagents necessary for development must be incorporated in advance in the light-sensitive materials. However, if such photographic reagents are added to the photographic light-sensitive materials in an active form, they will react with the other ingredients in the photographic light-sensitive materials during storage before being processed or will be decomposed by the influence of heat, oxygen, or the like, thus being unable to exhibit the expected capabilities upon processing. As one technique for solving this problem, there is a technique of blocking the active group of a photographic reagent to add it in a substantially inert form, i.e., as a photographic reagent precursor, to a photographic light-sensitive material. Where the useful photographic reagent is a dye, a functional group exerting a great influence on spectral absorption of the dye is blocked to shift the spectral absorption of dye to a shorter wavelength side or a longer wavelength side. This technique provides an advantage that, even when the dye is incorporated in the silver halide emulsion layer having the same light-sensitive spectral region, reduction in sensitivity due to the so-called filter effect never takes place. Where the useful photographic reagent is an anti-foggant or a development inhibitor, blocking of the active group thereof provides such advantages as that the desensitization effect due to adsorption thereof onto light-sensitive silver halide or formation of silver salts during storage, can be depressed and, at the same time that fog is reduced, excess development is depressed, or development is stopped at a necessary point, by the timely release of the photographic reagents. Where the useful photographic reagent is a developing agent, an auxiliary developing agent or a fogging agent, blocking of the active group or adsorptive group thereof provides such advantages as that various photographic adverse influences due to formation of semiquinones or oxidation products by air oxidation during storage are prevented, or that formation of fogging nuclei during storage is prevented by preventing the electron injection into the silver halide, thus realizing a stable processing. Where the photographic reagent is a bleaching accelerator or a bleach-fixing accelerator, blocking of the active group thereof provides the advantage that the reaction thereof with the other ingredients incorporated in the photogarphic light-sensitive materials is depressed during storage and, upon processing, the desired properties appear timely by removing the blocking group.

As to such blocking techniques for photographic reagents, several specific techniques have already been known with respect to the conventional photographic light-sensitive materials. For example, it has been known to utilize such blocking agents as an acyl group, a sulfonyl group, etc. described in Japanese Patent Publication No. 44,805/72; to utilize those blocking groups described in Japanese patent Publication Nos. 17,369/79, 9,696/80, and 34,927/80 and which release the photographic reagents by so-called reverse Michael reaction; to utilize those blocking groups described in Japanese Patent Publication No. 39,727/79, Japanese Patent Application (OPI) Nos. 135,944/82, 135,945/82, and 136,640/82 which release the phtotgraphic reagents upon formation of quinonemethide or quinonemethide-like compounds by intramolecular electron transfer; to utilize the intramolecular ring-closing reaction described in Japanese Patent Application No. 53,330/80; or to utilize 5- or 6-membered ring cleavage described in Japanese Patent Application (OPI) Nos. 76,541/82, 135,949,82, and 179,842/82. However, all of these known techniques utilize hydrolysis or deprotonation by the action of $OH^-$ upon wet-process development, and no precursor techniques for dry processing using an organic base have been known.

SUMMARY OF THE INVENTION

It is, therefore, an object of the present invention to provide a precursor technique for the photographically useful reagents in an image-forming process involving a heating step.

Another object of the present invention is to provide those compounds which are stable at ordinary temperatures, and which, only when heated in the heating step, release the photographically useful reagents.

A further object of the present invention is to provide a dry image-forming process which involves the heating step and which scarcely causes unevenness of the image even when the heating temperature is not uniform.

These and other objects of the present invention will become apparent from the following description thereof.

The above-described and other objects of the present invention are attained by the dry image-forming process which comprises conducting heating in the presence of the compound represented by the following general formula (I):

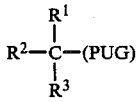

(I)

wherein:

$R^1$ and $R^2$, which may be the same or different, each represents a group selected from an aryl group, a substituted aryl group, a heterocyclic group, and a substituted heterocyclic group;

$R^3$ represents a hydrogen atom, an alkyl group, a substituted alkyl group, a cycloalkyl group, a substituted cycloalkyl group, an aralkyl group, a substitued aralkyl group, or groups which are referred to with respect to $R^1$ and $R^2$;

$R^1$, $R^2$, and $R^3$ may form a ring structure via a hydrocarbon chain, a hetero atom-containing hydrocarbon chain or a hetero atom, or may be directly bound to each other to form a ring structure; and PUG represents a photographically useful group.

DETAILED DESCRIPTION OF THE INVENTION

The present invention will be described in detail below.

As the aryl group used for $R^1$ and $R^2$, an aryl group having 6 to 18 carbon atoms are preferable, and preferable specific examples thereof include a phenyl group, a naphthyl group, an anthryl group, etc. As the substituents for the substituted aryl group, there are illustrated a substituted or unsubstituted alkyl group, a substituted or unsubstituted alkoxy group, a substituted or unsubstituted aryl group, a halogen atom, a cyano group, a nitro group, an alkyl or arylthio group, an alkyl- or arylsulfonyl group, a substituted or unsubstituted carbamoyl group, a substituted or unsubstituted sulfamoyl group, an amino group, a carboxy group, a sulfo group, an alkyl- or aryloxycarbonyl group, etc.

Preferable examples of the heterocyclic group include 5-, 6-, and 7-membered rings containing at least one of an oxygen atom, a nitrogen atom, and a sulfur atom, and fused rings thereof.

Specific examples of the heterocyclic group include those derived from pyridine, pyrimidine, triazine, pyrrole, imidazole, triazole, thiophene, furan, thiazole, oxazole, carbazole, benzothiazole, benzimidazole, benzotriazole, benzoxazole, pyridazine, pyrazole, purine, pyrazine, etc.

These heterocyclic groups may optionally have substituents illustrated as the substituents for the above-described aryl groups.

As the alkyl group used for $R^3$, a linear- or branched-chain alkyl group having 1 to 18 carbon atoms are preferable. Specific examples thereof include a methyl group, an ethyl group, a n-propyl group, a n-butyl group, a n-hexyl group, a n-heptyl group, a 2-ethylhexyl group, a n-decyl group, a n-dodecyl group, etc. As the substituents for the substituted alkyl group, there are illustrated a halogen atom, an alkoxy group, an aryloxy group, a cyano group, an alkyl- or arylthio group, a substituted or unsubstituted carbamoyl group, an alkyl- or arylsulfonyl group, a disubstituted amino group substituted by an alkyl or aryl group, a hydroxy group, a carboxy group, a sulfo group, an acylamino group, a sulfonylamino group, etc.

As the cycloalkyl group, a 5- or 6-membered cycloalkyl group having 5 to 10 carbon atoms are preferable. Specific examples thereof include a cyclopentyl group, a cyclohexyl group, etc.

Examples of the aralkyl group include a benzyl group, a $\beta$-phenethyl group, etc.

As the photographically useful reagents (PUG) to be released from the precursor compounds, there are illustrated, for example, an antifoggant, a development inhibitor, a developing agent, a development accelerator, an electron donor (E. D.), a fogging agent, a nucleating agent, a silver halide solvent, a bleaching accelerator, a blix-accelerating agent, a fixing accelerator, a dye, a color material for color diffusion transfer process, a coupler, a melting point-decreasing agent for heat-sensitive materials, a coupling-inhibiting group for diazo thermal photographic materials, etc. Specific examples of the antifoggant and the development inhibitor include nitrogen-containing heterocyclic compounds having a mercapto group. The developing agent and the development accelerator include hydroquinones, catechols, aminophenols, p-phenylenediamines, pyrazolidones, ascorbic acids, etc. The electron donor, the fogging agent and the nucleating agent include alpha-hydroxyketones, alpha-sulfonamidoketones, hydrazines, hydrazides, tetrazoliums, aldehydes, acetylenes, quaternary salts, ylides, etc. The silver halide solvent includes thioethers, rhodanines, hypo, methylenebissulfones, etc. The bleaching accelerator and the blix-accelerating agent include aminoethanethiols, sulfoethanethiols, aminoethanethiocarbamates, etc. The fixing accelerator includes hypo. The dye includes azo dyes, azomethine dyes, anthraquinone dyes, indophenol dyes, etc.

Of the above-described photographically useful groups, the development inhibitors provide particularly remarkable effects when they are blocked in the form of the general formula (I). Of the development inhibitors, those represented by the following generaly formula (II) provide especially articularly marked effects:

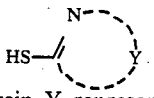

(II)

wherein Y represents atoms necessary for forming a 5-or 6-membered heterocyclic ring (preferably containing a sulfur atom, a nitrogen atom or an oxygen atom within the ring).

In the general formula (II), the blocking group is bound to the compound via the sulfur atom or the nitrogen atom.

Preferable examples of the development inhibitor represented by the general formula (II) are illustrated below.

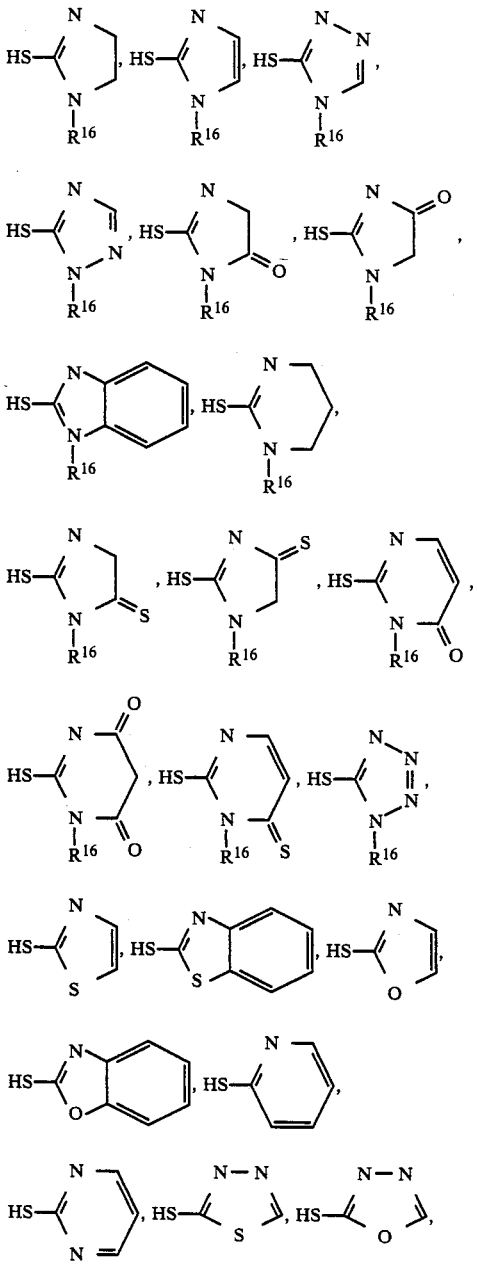

-continued

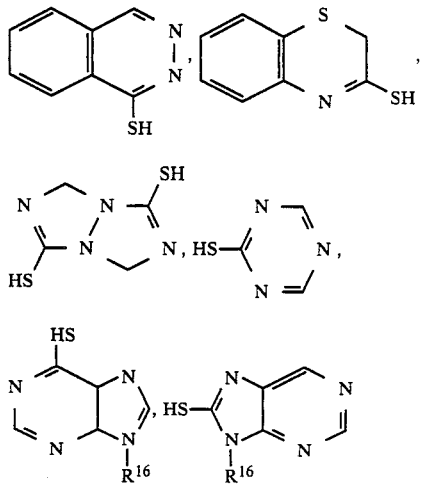

In the above formulae, $R^{16}$ represents a group selected from among a hydrogen atom, an alkyl group, an aryl group, a cycloalkyl group, an alkenyl group, and an aralkyl group. These groups may possess a proper substituent or substituents, and typical examples thereof being those which are illustrated as substituents with respect to $R^3$. The carbon atoms forming the above-described ring structure may be substituted by other substituents than a hydrogen atom, typical examples thereof being those substituents which are referred to for the aforementioned benzene or naphthalene ring.

It is known that the nitrogen-containing heterocyclic compounds having a mercapto group and being represented by the general formula (II) exhibit a development-inhibiting effect in silver halide light-sensitive materials. In addition, Japanese Patent Application No. 176,351/84 describes the same effect in the thermally developable light-sensitive materials. However, when a compound represented, for example, by the formula (II) is added to an emulsion layer from the first, development will be inhibited from the initial stage of development, resulting in a reduced image density and a low sensitivity. However, the compounds of the present invention represented by the general formula (I) can stop development without decreasing image density, since they gradually release the development inhibitor (II) upon thermal development.

In addition, thermally developable light-sensitive materials having the ability of compensating unevenness of the developing temperature are obtained by incorporating the compound (I) of the present invention wherein development inhibitor (II) is blocked. While development is conducted at a high temperature of 100° C. or above, slight temperature unevenness is usually unavoidable. Portions of a higher temperature acquire a higher image density, whereas portions of a lower temperature acquire a lower image density, and thus image unevenness as a whole, particularly fog unevenness in non-image portions, results. In the case of heat-transferring a mobile dye, development can also proceed in some cases, resulting in an increased fog, and where the heating temperature is uneven, the transferred image is also uneven. However, the use of the compound (I) of the present invention has successfully led to reduction of the unevenness of the image density as a whole, since the compound (I) releases a greater amount of the development inhibitor in portions of a higher temperature to depress the unevenness of the image density.

The compound (I) of the present invention is considered to release PUG (or its dissociation product) by the nucleophilic substitution reaction with a nucleophilic agent upon the heating step.

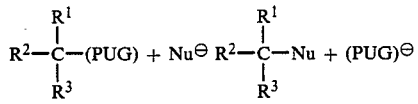

$Nu^{\ominus}$: Nucleophilic reagent

The present invention is characterized in that at least two of $R^1$, $R^2$, and $R^3$ are aryl groups or heterocyclic groups. Such structure is known to generally undergo the above-described substitution reaction under an acidic condition. For example, R. W. Hanson et al reported that a diarylmethyl group is a useful protective group for an amino group or a thiol group of amino acids in peptide synthesis (R. W. Hanson and H. D. Law; J. Chem. Soc., 1965, 7285). In this case, deprotection is attained in a 50% acetic acid aqueous solution.

It has now been newly found that the compound (I) of the present invention can easily release a photographically useful group in a dry film under a neutral or basic condition.

This may be attributed to that, as is described hereinbefore, the substitution reaction proceeds by the attack of a neculeophilic reagent in a dry film. In a solution, however, such reaction between the nucleophilic reagent and the compound (I) is extremely slow or never proceeds. For example, with a compound (I) wherein $R^1$ and $R^2$ both represent a phenyl group, and $R^3$ represents a hydrogen atom, no lease of a photographically useful group is confirmed when it is heated in a solution together with a base.

Therefore, it is unexpected to discover that the aforesaid substitution reaction effectively takes place in a short time in a film upon being heated.

The source and identity of this nucleophilic reagent is not clear, but may by expected to be, for example, various terminal residues (e.g., $-NH_2$, $-OH$, $-CO_2H$, $-SH$,

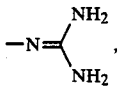

etc.) of the amino acids constituting gelatin which forms a binder.

In the case of using a base or a base precursor as a development accelerator, the base functions as a nucleophilic reagent in the heating step, and the use in combination of the base or its precursor and the compound (I) of the present invention is particularly advantageous.

Specific examples of the compounds of the present invention are illustrated below which, however, are not to be construed as limiting the present invention in any way.

(1)

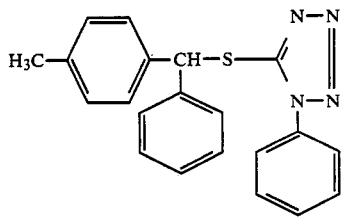

(2)

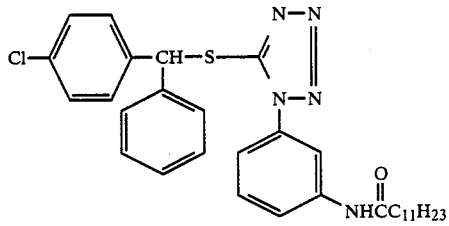

(3)

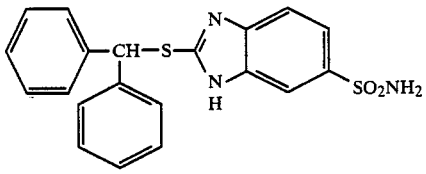

(4)

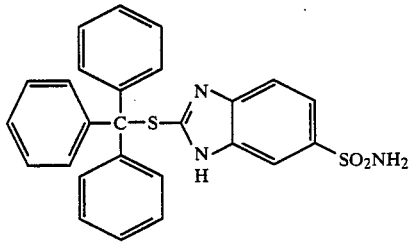

(5)

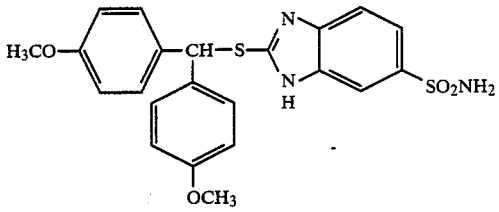

(6)

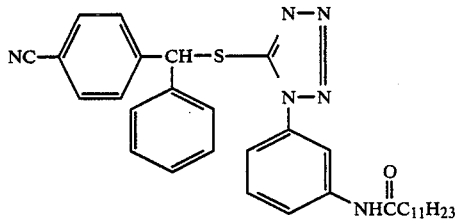

(7)

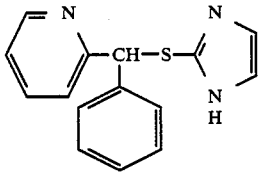

-continued
(8)
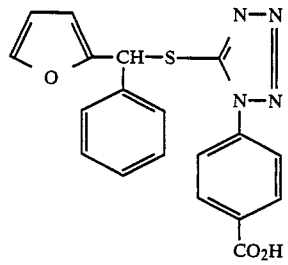
(9)
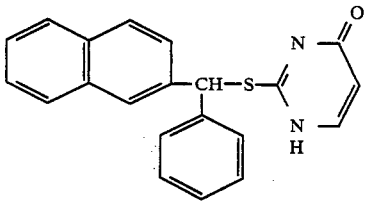
(10)
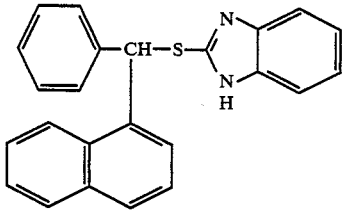
(11)
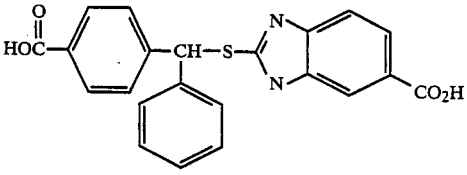
(12)
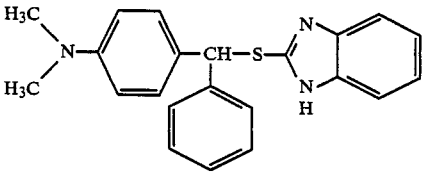
(13)
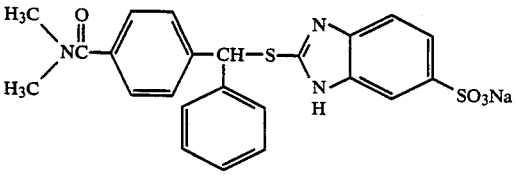
(14)
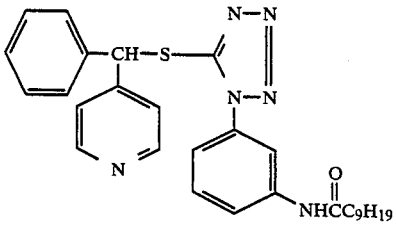
-continued
(15)
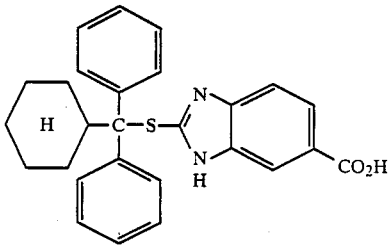
(16)
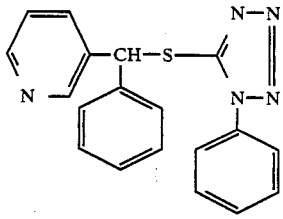
(17)
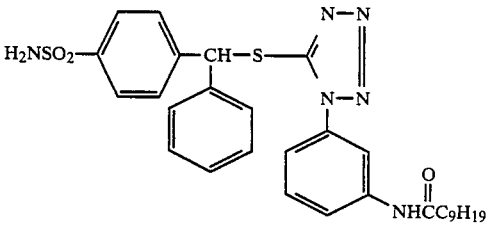
(18)
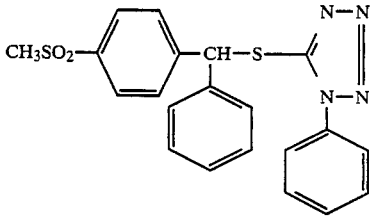
(19)
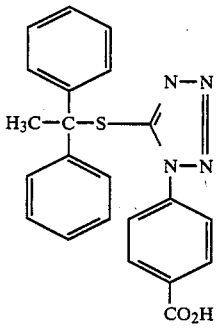
(20)
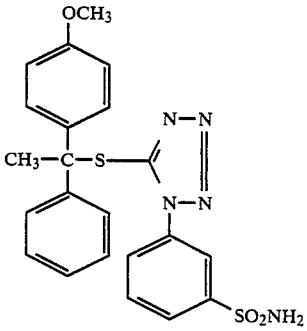

-continued
(21)
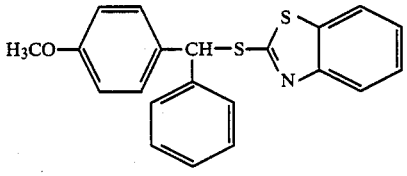
(22)
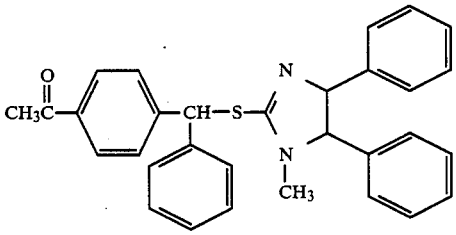
(23)
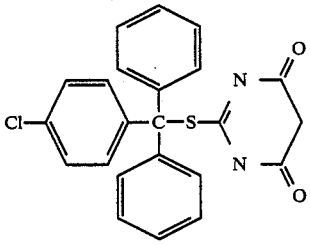
(24)
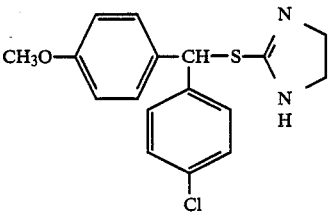
(25)
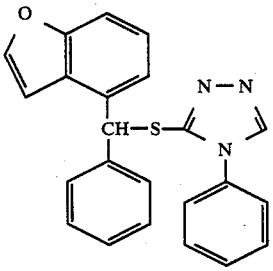
(26)
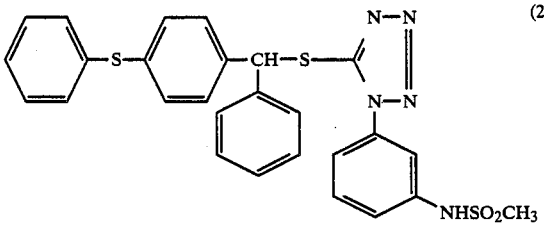
(27)
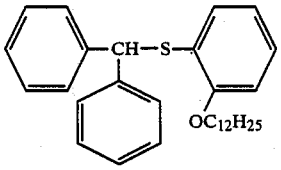
-continued
(28)
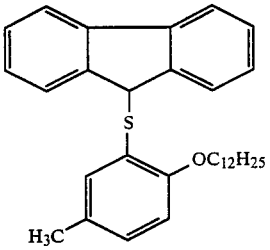
(29)
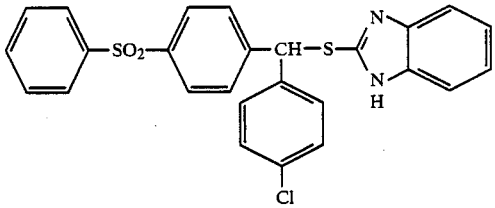
(30)
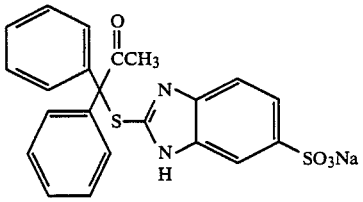
(31)
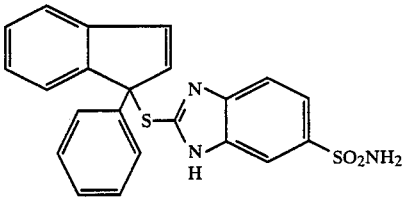
(32)
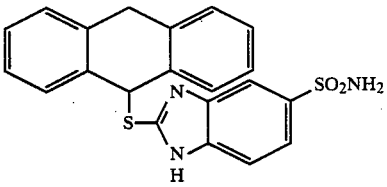
(33)
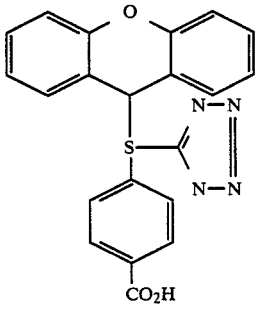

-continued
(34)
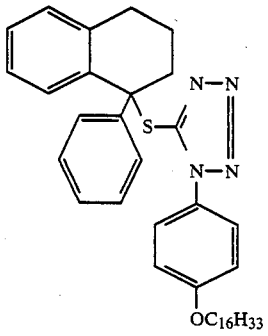
(35)
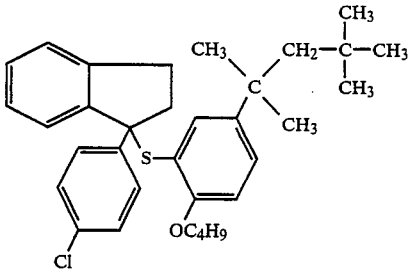
(36)
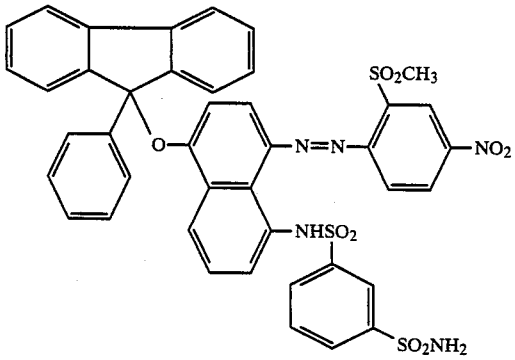
(37)
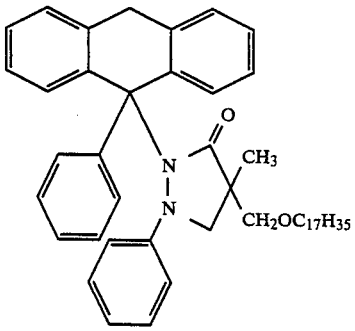
(38)
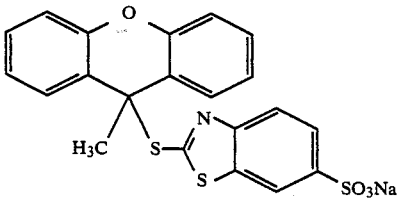
-continued
(39)
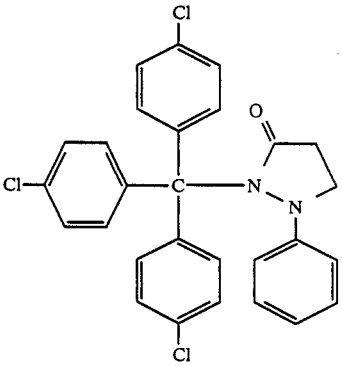
(40)
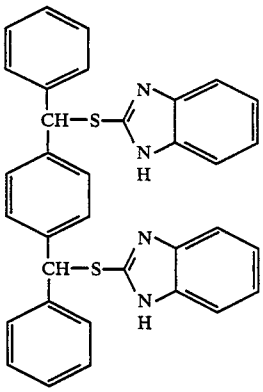
(41)
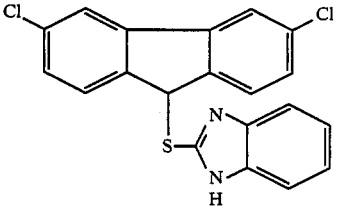
(42)
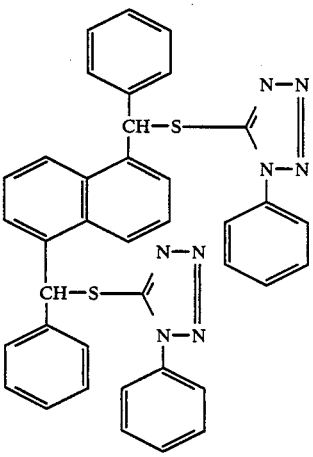

-continued (43)

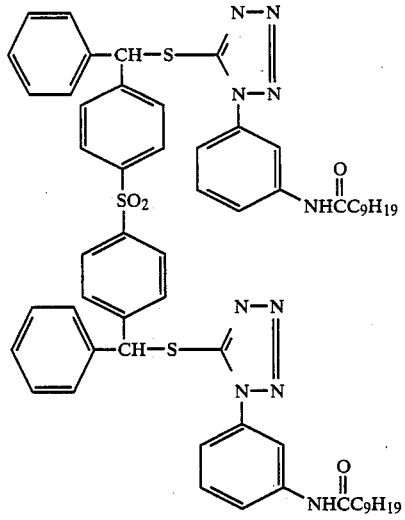

Process for synthesizing the compounds of the present invention is described below.

Compounds (I) of the present invention can be synthesized by the following reaction:

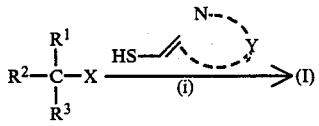

wherein X represents a halogen atom and Y is the same meaning as the general formula (II).

The starting halide compound (wherein the case when $R^1$ and $R_2$ each represents an aryl group and $R^3$ represents a hydrogen atom) can be synthesized by the following route using a benzophenone derivative according to the technique of R. W. Hanson et al (R. W. Hanson and H. D. Law; J. Chem. Soc., 1965, 7285).

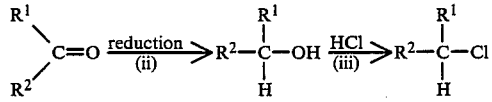

In the condensation reaction of step (i), an organic base such as triethylamine or an inorganic base such as potassium carbonate is preferably used. Previous preparation of a sodium salt of thiol serves to smoothly conduct the reaction.

As the reducing agent to be used in step (ii), metals such as zinc and metal-hydride complex compounds such as lithium aluminum hydride are illustrated. As to more detailed descriptions, reference may be made to, for example, "Shin-Jikken Kagaku Koza (Lectures on Experimental Chemistry), Vol. 15, Sanka to Kangen (Oxidation and Reduction) (II)" (compiled by the Japanese Chemical Society and published by Maruzen Co., Ltd. in 1977).

In the substitution reaction of step (iii), hydrogen halides such as hydrogen chloride, phosphorus halides, or thionyl halides are preferably used. As to more detailed descriptions, reference may be made to, for example, "Shin-Jikken Kagaku Koza (Lectures on Experimental Chemistry), Vol. 14, Yukikagobutsu no Gosei to Hanno (Synthesis and Reaction of Organic Compounds) (I)" (compiled by the Japanese Chemical Society and published by Maruzen Co., Ltd. in 1977).

SYNTHESIS EXAMPLE 1

Synthesis of Compound (3)

50 ml of a dimethylformamide solution containing 12.2 g (0.06 mol) of commercially available diphenylchloromethane, 11.5 g (0.05 mol) of 2-mercaptobenzimidazole-5-sulfonamide, and 8.3 g (0.06 mol) of anhydrous potassium carbonate was heated at 100° C. for one hour under stirring. After completion of the reaction, 200 ml of water was added to the reaction solution. A precipitate formed was extracted with ethyl acetate and, after separation, ethyl acetate was distilled off under reduced pressure.

The residue was purified through silica gel column chromatography (silica gel: 700 g; eluent: a mixture of ethyl acetate and chloroform (v/v=1/1)), concentrated under reduced pressure, and crystallized from a mixed solvent of ethyl acetate and n-hexane (v/v=1/1) to obtain 10.0 g (0.025 mol) of Compound (3). (m.p.: 183°-184° C.)

SYNTHESIS EXAMPLE 2

Synthesis of Compound (4)

80 ml of dimethylacetamide solution containing 16.7 g (0.06 mol) of commerically available triphenylchloromethane, 11.5 g (0.05 mol) of 2-mercaptobenzimidazole-5-sulfonamide, and 5.1 g (0.05 mol) of triethylamine was stirred at 50° C. for 2 hours. After completion of the reaction, 200 ml of ethyl acetate and 200 ml of water were added to the reaction solution and, after extraction and separation, an ethyl acetate layer was washed with water and dried with magnesium sulfate. Then, ethyl acetate was distilled off under reduced pressure, followed by crystallization of the residue from n-hexane to obtain 8.5 g (0.018 mol) of compound (4). (mp. >215° C.)

The amount of the compound in accordance with the present invention to be used varies depending upon the kind of the compound and the system. In general, the compound is used in amount of not more than 50 wt % based on the weight of the coated film, with not more than 30 wt % being preferable. The optimal amount of the compound greatly depends on the structure of the development inhibitor (II) to be released. Among the aforesaid development inhibitors (II), there are compounds which accelerate development contrary to inhibition when used in a small amount, though inhibiting development when used in an increased amount. Therefore, when compound (I) of the present invention which releases such compound (II) is added, the initial development is accelerated and, the later development is inhibited, thus such compound being particularly advantageous.

The compounds of the present invention can be incorporated in a binder by dissolving them in a water-miscible organic solvent (e.g., methanol, ethanol, acetone, dimethylformamide, etc.) or a mixture solvent of this organic solvent and water.

The hydrophobic compounds of the present invention may also be incorporated in a binder as fine particles formed by the oil-protecting process.

The compounds of the present invention may be used alone or in combination of two or more. Further, they may be used in combination with development-stopping agents or development-stopping techniques outside the scope of the present invention. As such development-stopping agents and development-stopping techniques, it has been known, for example, to utilize the thermal decomposition of aldoxime esters described in Japanese Patent Application No. 216,928/83 and U.S. patent application Ser. No. 711,885 (filed on Mar. 14, 1985), to utilize Lossen rearrangement described in U.S. patent application Ser. No. 727,718 (filed on Apr. 26, 1985), and to use carboxylic acid esters described in U.S. patent application Ser. No. 727,978 (filed on Apr. 26, 1985) involving a heating step means a process in which a heating step exists at any stage in the image-forming process, regardless of whether the heating is conducted for development or for transfer. The heating may be conducted imagewise.

Thermally developable light-sensitive materials, which are adapted for an image-forming process wherein heating is conducted for development, include those which use silver halides and those which use diazo compounds. The compounds of the present invention may be added to these light-sensitive materials or, where an image-receiving layer is provided on a different support, they may be added to any of the layers provided on the support. Further, they may be supplied from outside upon heating.

In the present invention, it is preferable to use a so-called thermally developable light-sensitive material (for example, those described in the aforementioned prior art) in the image-forming process involving a heating step. In such case, the compound represented by the general formula (I) may be incorporated in any of the layers (for example, light-sensitive layer, interlayer, protective layer, etc.) forming the thermally developable light-sensitive material and existing on a support, or in any of the layers of a dye-fixing material to which the mobile dye distributed imagewise are transferred to fix there.

As the thermally developable light-sensitive materials, those wherein silver halide is used as a light-sensitive substance are the most preferable because silver ion in a dry film acts on the photographically useful group in the compound (I) to render the substitution reaction by the nucleophilic reagent easy to take place.

The heating temperature to be employed is suitably about 50° C. to about 250° C., particularly 60° C. to 180° C. being preferable.

Silver halides to be used in the present invention may be any of silver chloride, silver bromide, silver iodide, silver chlorobromide, silver chloroiodide, silver bromoiodide, and silver chlorobromoiodide. Halide composition within the grains may be uniform or different between the surface and the inner portion of the grains to form a multi-layered structure (Japanese Patent Application (OPI) Nos. 108,533/83, 52,237/84, U.S. Pat. Nos. 4,444,877, 4,507,386, 4,433,048, and European Pat. No. 100,984). The platy grains having a thickness of 0.5 μm or less, a diameter of at least 0.6 μm, and an average aspect ratio of 5 or more (U.S. Pat. Nos. 4,414,310, 4,435,494, West German Patent (OLS) No. 3,241,646A1, etc.) and the mono-disperse emulsions having an almost uniform grain size distribution (Japanese Patent Application (OPI) No. 14,829/83, U.S. Pat. Nos. 4,446,228, 4,446,226, 4,511,648, International Pat. Laid-Open No. 83/02338A1, European Pat. Nos. 64,421A3 and 83,377A1, etc.) are also usable in the present invention. Two or more silver halides different from each other in the crystal habit, the silver halide composition, the grain size distribution, etc. may be used. Two or more mono-disperse emulsions different in grain size may be mixed with each other to adjust the gradation.

Silver halide grains to be used in the present invention preferably have an average grain size of 0.001 μm to 10 μm, more preferably 0.001 μm to 5 μm. These silver halide emulsions may be prepared by any of an acidic process, a neutral process and an ammoniacal process. As a manner of reacting a soluble silver salt with a soluble halide salt, any of the single-jet method, the double-jet method, and the combination thereof may be employed. The reverse Jet method of forming grains in the presence of excess silver ion, or the controlled double jet method wherein pAg is kept constant may be employed. Further, for the purpose of accelerating grain growth, the concentrations, the adding amounts or the adding rates of silver salts and halides may be raised (Japanese Patent Application (OPI) Nos. 142,329/80, 158,124/80, U.S. Pat. No. 3,650,757, etc.).

Epitaxial conjunction type silver halide grains are also usable (U.S. Pat. Nos. 4,349,622, 4,094,684, etc.).

In the case of independently using silver halides without the organic silver salt oxidizing agent, it is preferable to use silver chloroiodide, silver bromoiodide or silver chlorobromoiodide having an X-ray pattern showing the existence of silver iodide crystals.

Silver salts having the above-described characteristics may be obtained, for example, by adding a silver nitrate solution to a potassium bromide solution to form silver bromide grains, then adding thereto potassium iodide.

In the step of forming silver halide grains to be used in the present invention, ammonia, organic thioether derivatives described in Japanese Patent Publication No. 11,386/72 or sulfur-containing compounds described in Japanese Patent Application (OPI) No. 144,319/78 may be used as silver halide solvents.

In the step of grain formation or physical ripening, cadmium salts, zinc salts, lead salts, thallium salts, etc. can coexist.

Further, water-soluble iridium salts such as iridium (III, IV) chloride, ammonium hexachloroiridate, etc. or water-soluble rhodium salts such as rhodium chloride may be used for the purpose of removing high- and low-reciprocity failures.

Soluble salts may be removed from the silver halide emulsion after formation of precipitate or after physical ripening. This removal may be conducted according to the noodle-washing process or the sedimentation process.

The silver halide emulsion may be used without post-ripening, but are usually chemically sensitized to use. Sulfur sensitization process, reduction, sensitization process, noble metal sensitization process, etc. known with the emulsions for the ordinary light-sensitive materials may be employed alone or in combination. These chemical sensitizations may be conducted in the presence of nitrogen-containing heterocyclic compounds (Japanese Patent Application (OPI) Nos. 126,526/83 and 215,644/83).

The silver halide emulsions to be used in the present invention may be the surface latent image type forming latent image mainly on the grain surface or the internal latent image type forming latent images within the grain. Direct reversal emulsions wherein the internal latent image type emulsion is combined with a nucleating agent may also be used. Internal latent image type emulsions adapted for this purpose are described in U.S. Pat. Nos. 2,592,250, 3,761,276, Japanese Patent Publication No. 3,534/83, Japanese Patent Application (OPI) No. 136,641/82, etc. Nucleating agents preferably used in the present invention are described in U.S. Pat. Nos. 3,227,552, 4,245,037, 4,255,511, 4,266,031, 4,276,364, West German Patent Application (OLS) No. 2,635,316, etc.

The light-sensitive silver halide to be used in the present invention is coated in a silver amount of 1 mg/m$^2$ to 10 g/m$^2$.

In the present invention, organic metal salts comparatively stable against light may be used as an oxidant together with a light-sensitive silver halide. In this case, the light-sensitive silver halide and the organic metal salt must be in contact with each other or within a near distance from each other. Of such organic metal salts, organic silver salts are particularly preferable. In using the organic metal salt together with the silver halide, the organic metal salt is considered to participate in the redox reaction with the catalytic aid of the silver halide latent image when the thermally developable light-sensitive material is heated to 80° C. or above, preferably 100° C. or above.

As the organic compounds to be used for forming the above-described organic silver salt oxidizing agents, there are illustrated aliphatic or aromatic carboxylic acids, compounds having mercapto groups or alpha-hydrogen containing thiocarbonyl groups, imino group-containing compounds, etc.

As the typical examples of the silver salts of aliphatic carboxylic acid, there are illustrated silver salts derived from behenic acid, stearic acid, oleic acid, lauric acid, capric acid, myristic acid, palmitic acid, maleic acid, fumaric acid, tartaric acid, furic acid, linoleic acid, linolenic acid, oleic acid, adipic acid, sebacic acid, succinic acid, acetic acid, butyric acid, and camphoric acid. Silver salts derived from halogen atom- or hydroxy group-substituted derivatives of these aliphatic acids or silver salts derived from thioether group-containing aliphatic carboxylic acids are also usable.

Typical examples of the silver salts of aromatic carboxylic acid and other carboxy group-containing compounds include silver salts derived from benzoic acid, 3,5-dihydroxybenzoic acid, o-, m- or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, 3-carboxymethyl-4-methyl-4-thiazoline-2-thione, etc. As the silver salts of mercapto or thiocarbonyl group-containing compounds, there are illustrated silver salts derived from 3-mercapto-4-phenyl-1,2,4-triazole, 2-mercaptobenzimidazole, 2-mercapto-5-aminothiadiazole, 2-mercaptobenzothiazole, S-alkylthioglycolic acid (containing 12 to 22 carbon atoms in the alkyl moiety), dithiocarboxylic acids (e.g., dithioacetic acid, etc.), thioamides (e.g., thiostearoamide, etc.), and mercapto compounds described in U.S. Pat. No. 4,123,274 such as 5-carboxy-1-methyl-2-phenyl-4-thiopyridine, mercaptotriazine, 2-mercaptobenzoxazole, mercaptooxadiazole, 3-amino-5-benzylthio-1,2,4-triazole, etc.

Typical examples of silver salts of imino group-containing compounds include silver salts derived from benzotriazole or derivatives thereof described in Japanese Patent Publication Nos. 30,270/69 and 18,416/70, such as benzotriazole, alkyl-substituted benzotriazoles (e.g., methylbenzotriazoles, etc.), halogen-substituted benzotriazoles (e.g., 5-chlorobenzotriazole, etc.), carboimidobenzotriazoles (e.g., butylcarboimidobenzotriazole, etc.), nitrobenzotriazoles described in Japanese Patent Application (OPI) No. 118,639/83, sulfobenzotriazoles described in Japanese Patent Application (OPI) No. 118,638/83, carboxybenzotriazole or salts thereof, hydroxybenzotriazoles, 1,2,4-triazoles described in U.S. Pat. No. 4,220,709, 1H-tetrazole, carbazole, saccharin, imidazole, and derivatives thereof.

In addition, silver salts described in Research Disclosure (RD-17029, June, 1978), organic metal salts other than silver salts such as copper stearate, and silver salts of alkynyl group-containing carboxylic acids such as phenylpropiolic acid described in Japanese Patent Application No. 221,535/83 are also usable in the present invention.

These organic silver salts can be used in an amount of 0.01 to 10 mols, preferably 0.01 to 1 mol, per mol of the light-sensitive silver halide. The sum of the amount of the coated light-sensitive silver halide and the amount of the coated organic silver salt suitably ranges from 50 mg to 10 g/m$^2$.

Silver halide to be used in the present invention may be spectrally sensitized with methine dyes or the like. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes. In these dyes, any of nuclei ordinarily used as basic hetero ring nuclei in cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused with an aromatic ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. can be used. These nuclei may be substituted in the carbon atoms.

In the merocyanine dyes or complex merocyanine dyes, 5- or 6-membered hetero ring nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc. may be used as ketomethylene structure-containing nuclei.

These sensitizing dyes may be used alone or in combination. Combinations of the sensitizing dyes is often employed particularly for the purpose of supersensitization.

A dye which itself does not have a spectrally sensitizing effect or a substance which substantially does not absorb visible light and which shows a supersensitizing effect may be incorporated together with the sensitizing dye in the emulsion. For example, aminostylyl compounds substituted by a nitrogen-containing hetero ring group (for example, those described in U.S. Pat. Nos. 2,933,390 and 3,635,721), aromatic organic acid-formaldehyde condensates (for example, those described in U.S. Pat. No. 3,743,510), cadmium salts, azaindene compounds, etc. may be incorporated. Combinations described in U.S. Pat. Nos. 3,615,613, 3,615,641, 3,617,295, and 3,635,721 are particularly useful.

In incorporating these sensitizing dyes in silver halide photographic emulsions, they may be directly dispersed in the emulsions, or may be dissolved in a single solvent or a mixed solvent of water, methanol, ethanol, acetone, methyl cellosolve, etc. to add to the emulsions. Further, they may be dissolved in a substantially water-immiscible solvent such as phenoxyethanol, the resulting solution being dispersed in water or a hydrophilic colloid to add to the emulsions as a dispersion. The sensitizing dyes may be added to the emulsion simultaneously with oleophilic compounds such as dye-providing substances by mixing the sensitizing dyes with the oleophilic compounds. In the case of dissolving the sensitizing dyes, the sensitizing dyes used in combination may be separately dissolved, or may be dissolved as a mixture. In the case of adding them to an emulsion, they may be added at the same time as a mixture, may be separately added, or may be added simultaneously with other additives. The stage of the addition thereof to an emulsion may be the stage of chemical ripening or before or after it, or may be before or after formation of silver halide grains according to U.S. Pat. Nos. 4,183,756 and 4,225,666.

The amount thereof to be added generally ranges from about $10^{-8}$ to about $10^{-2}$ mol per mol of silver halide.

In the present invention, an embodiment of incorporating a compound which produces or releases a mobile dye, upon reduction of light-sensitive silver halide to silver at elevated temperatures, as a direct or inverse function of this reaction, i.e., a dye-providing substance is preferable.

This dye-providing substance is described below.

As the examples of the dye-providing substance to be used in the present invention, couplers capable of reacting with a developing agent are first illustrated. This coupler-utilizing process is a process wherein an oxidation product of a developing agent produced by the oxidation-reduction reaction between silver salt and developing agent reacts with a coupler to form a dye. Specific examples of the developing agent and the coupler are described in, for example, T. H. James; "The theory of the photographic process" 4th. Ed., pp. 291–234 and 354–361, "Shashin Kagaku (Photographic Chemistry)" 4th Ed., (written by Shinichi Kikuchi and published by Kyoritsu Shuppan), pp. 284–295, and the like.

Dye-silver compounds wherein an organic silver salt is bound to a dye are also included in the dye-providing substances. Specific examples of the dye-silver compound are described in Research Disclosure, May 1978, pp. 54–55 (RD-16966), etc.

In addition, azo dyes to be used in the thermally developable silver-dye bleach process are also included in the dye-providing substances. Specific examples of the azo dye and bleaching process therefor are described in U.S. Pat. No. 4,235,957, Research Disclosure, April 1976, pp. 30–32 (RD-14433), etc.

Leuco dyes described in U.S. Pat. Nos. 3,985,565, 4,022,617, etc. are also included in the dye-providing substances.

As another type of dye-providing substance particularly preferable in the present invention, there are illustrated those compounds which have the function of imagewise releasing or diffusing a diffusible dye, and which are utilized in the process described in, for example, European Pat. No. 76,492.

This type of compound can be represented by the following general formula (LI):

$$(\text{Dye—X})_n\text{—Y} \qquad \text{(LI)}$$

wherein:

Dye represents a dye moiety or a dye precursor moiety;

X represents a mere bond or a linking group;

Y represents a group which produces a difference in diffusibility of the compound represented by $(\text{Dye—X})_n$—Y in a direct or inverse function with the light-sensitive silver salt having imagewise latent image, or which releases Dye to produce a difference in diffusibility between the released Dye and the compound represented by $(\text{Dye—X})_n$—Y; and n represents 1 or 2, provided that when n represents 2, two Dye—X groups may be the same or different.

As specific examples of the dye-providing substances represented by the general formula (LI), dye developers wherein a hydroquinone type developing agent is bound to a dye component are described in U.S. Pat. Nos. 3,134,764, 3,362,819, 3,597,200, 3,544,545, 3,482,972, etc. In addition, Japanese Patent Application (OPI) No. 63,618/76, etc. describe substances which release a diffusible dye by the intramolecular nucleophilic substitution reaction, and Japanese Patent Application (OPI) No. 111,628/74, etc. describe substances which release a diffusible dye by the intramolecular re-cyclizing reaction of an isoxazolone ring. All of these processes are processes wherein the diffusible dyes are released or diffused in portions where development has not taken place, and no dyes are released or diffused in portions where development has taken place.

In these processes, it is extremely difficult to obtain images with a high S/N ratio, since development and release or diffusion of dye proceed in parallel. In order to remove this defect, a process has been invented in which the dye-releasing compound is incorporated as an oxidized form together with a reducing agent or a precursor thereof and, after development, the reducing agent not having been oxidized reduces the dye-releasing compound to thereby release a diffusible dye. Specific examples of the dye-providing substances to be used for such process are described in Japanese Patent Application (OPI) Nos. 110,827/78, 130,927/79, 164,342,81, and 35,533/78.

On the other hand, as substances that release a diffusible dye in the areas where development has taken place, those substances which release a diffusible dye upon the reaction between a coupler having a diffusible dye as an eliminating group and an oxidation product of a developing agent are described in British Pat. No. 1,330,542, Japanese Patent Publication No. 39,165/73, U.S. Pat. No. 3,443,940, etc., and those substances which produce a diffusible dye upon the reaction between a coupler having a diffusion-resistant group as an eliminating group and an oxidation product of a developing agent are described in U.S. Pat. No. 3,227,550, etc.

With the process of using these color developers, stain of image due to the oxidation decomposition products of the developers is a serious problem. For the purpose of solving this problem, dye-releasing compounds which themselves have a reducing ability without the developers are proposed. Typical examples thereof are illustrated below together with the literature name. Definitions with the general formulae are given in individual literature.

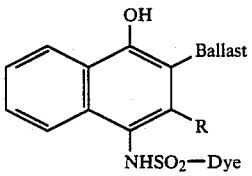

U.S. Pat. No. 3,928,312, etc.

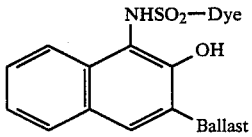

U.S. Pat. No. 4,053,312, etc.

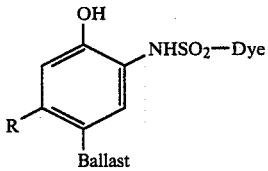

U.S. Pat. No. 4,055,428, etc.

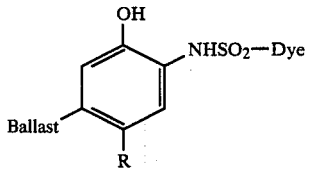

U.S. Pat. No. 4,336,322

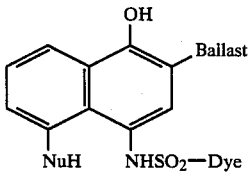

Japanese Patent Application (OPI) No. 65,839/84

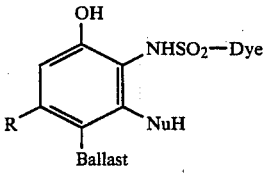

Japanese Patent Application (OPI) No. 69,839/84

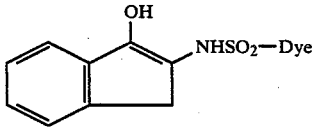

Ballast
Japanese Patent Application (OPI) No. 3,819/78

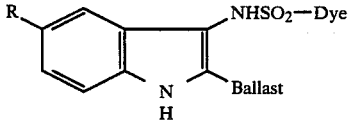

-continued

Japanese Patent Application (OPI) No. 104,343/76

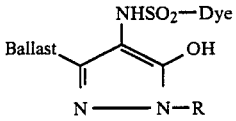

Japanese Patent Application (OPI) No. 104,343/76

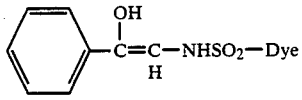

Japanese Patent Application (OPI) No. 104,343/76

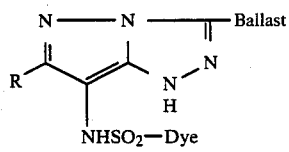

Research Disclosure, No. 17465

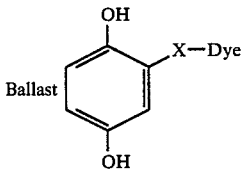

U.S. Pat. No. 3,725,062

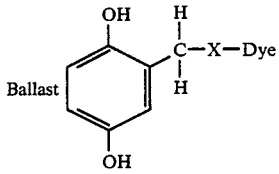

U.S. Pat. No. 3,728,113

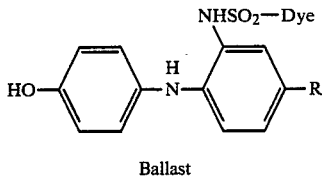

U.S. Pat. No. 3,443,939

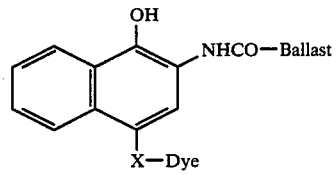

Japanese Patent Application (OPI) No. 116,537/83

All of the above-described various dye-providing substances can be used in the present invention.

Specific examples of the image-forming substances to be used in the present invention are described in the aforementioned patent literature. All of the preferable examples thereof cannot be illustrated here, and hence part of them are illustrated below. For example, examples of the dye-providing substance represented by the foregoing general formula (LI) are illustrated below.

LI-1
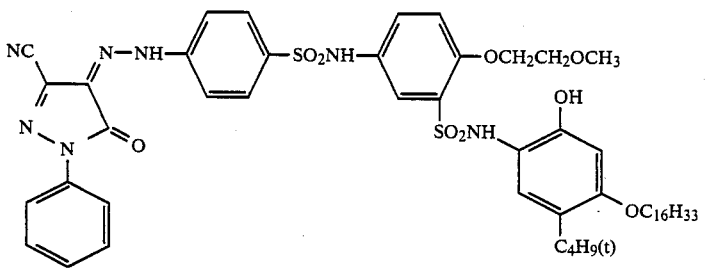
LI-2
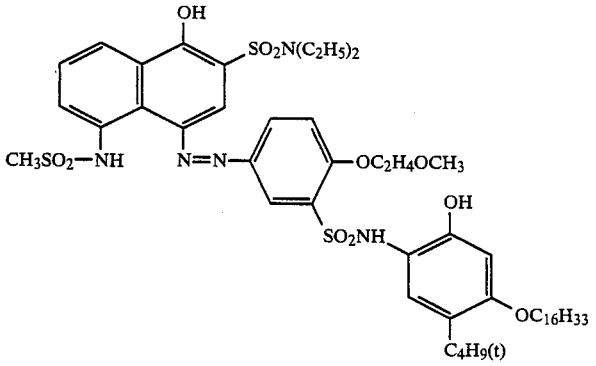
LI-3
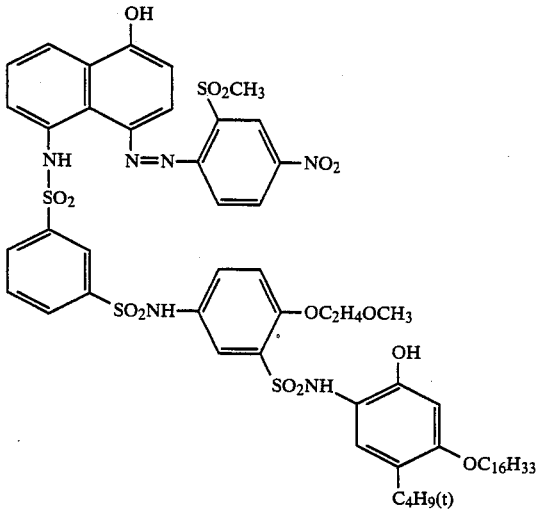
LI-4
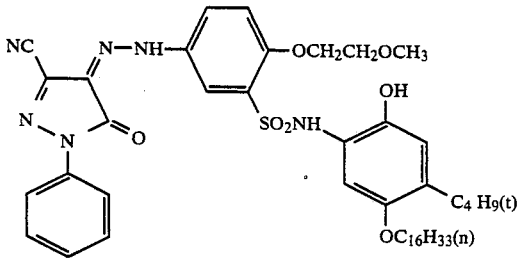

-continued
LI-5
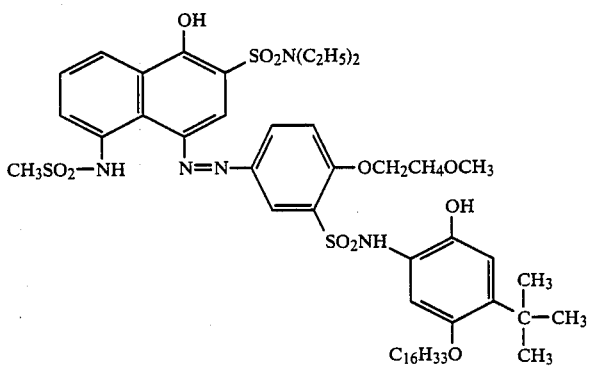
LI-6
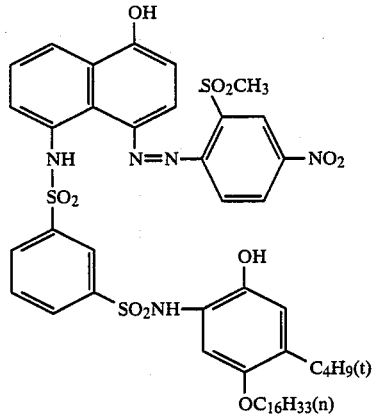
LI-7
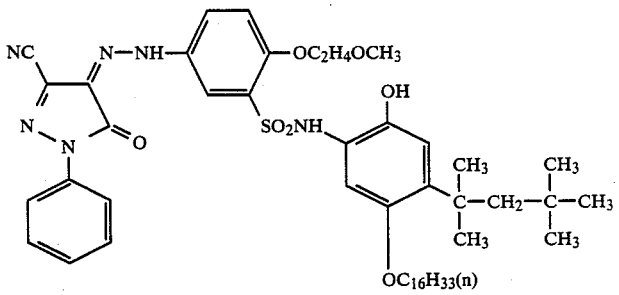
LI-8
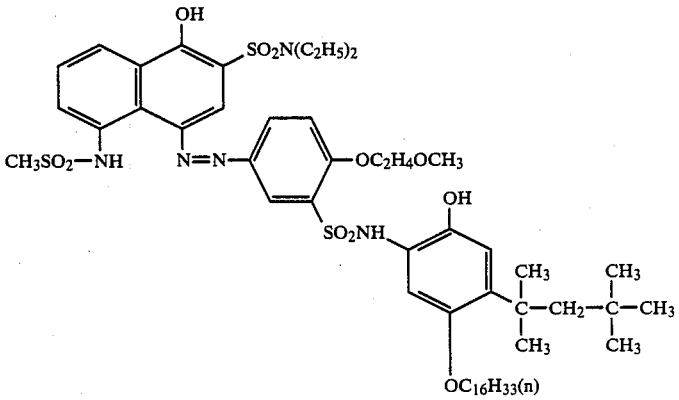

-continued
LI-9
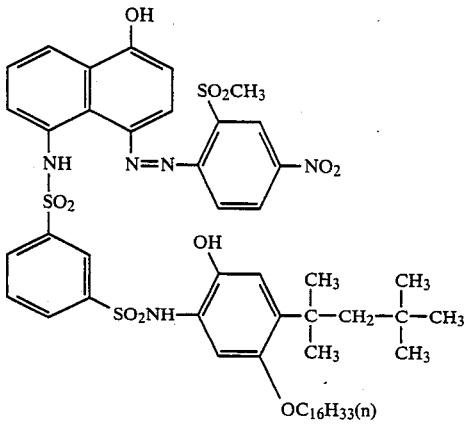
LI-10
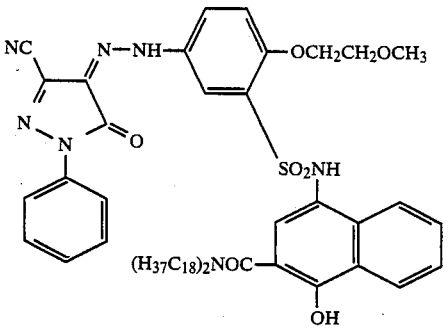
LI-11
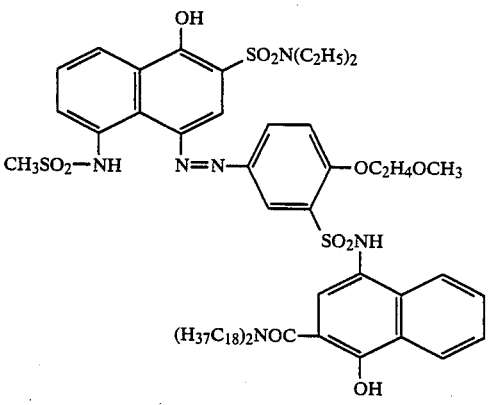
LI-12
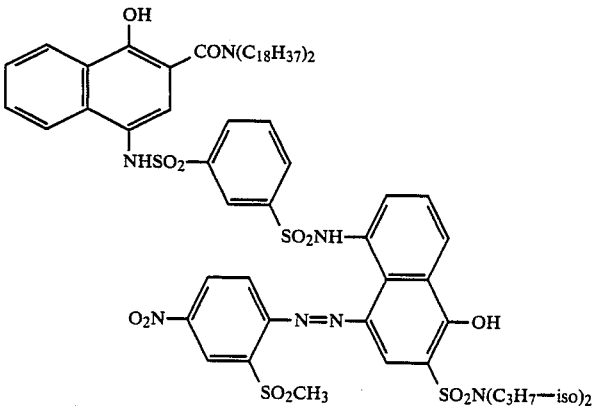

-continued
LI-13
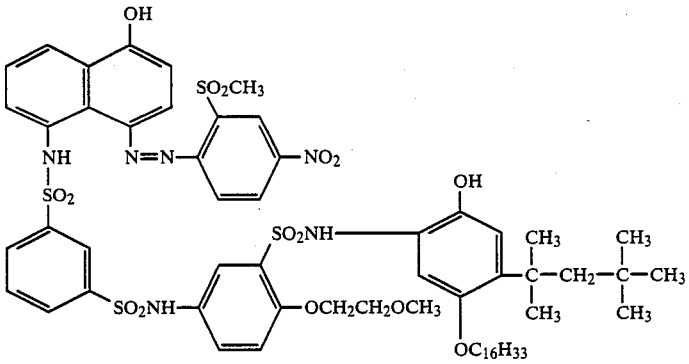
LI-14
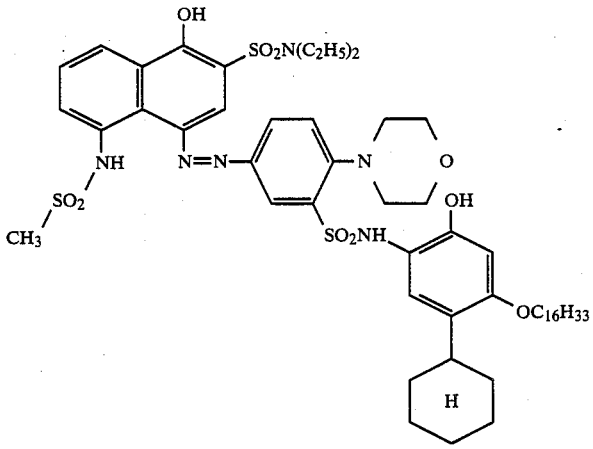
LI-15
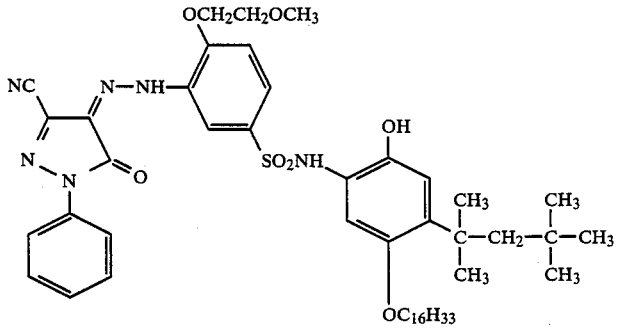
LI-16
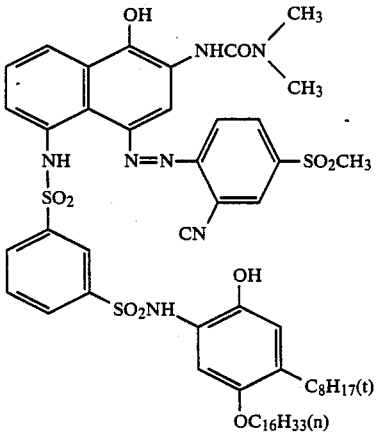

-continued

LI-17

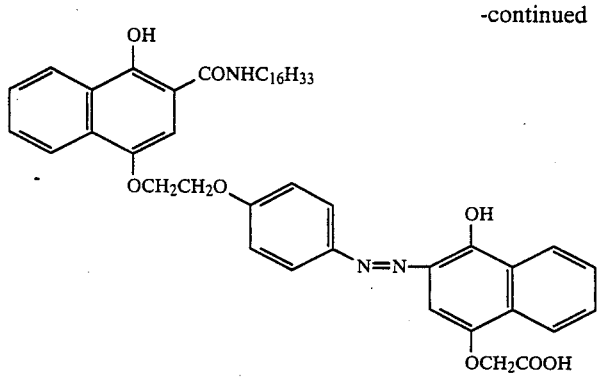

LI-18

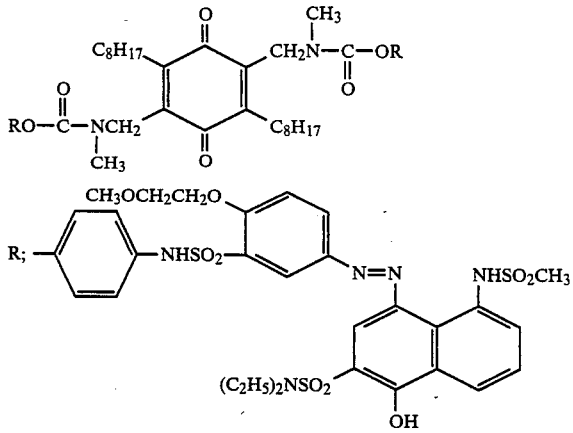

The above-described compounds are only part of the dye-providing substances, and are not limitative at all.

In the present invention, the dye-providing substance can be introduced into a layer of a light-sensitive material according to known processes described in, for example, U.S. Pat. No. 2,322,027. In this case, high-boiling organic solvents and low-boiling organic solvents are described below can be used.

For example, the dye-providing substance is dissolved in a high-boiling organic solvent such as an alkyl phthalate (e.g., dibutyl phthalate, dioctyl phthalate, etc.), a phosphate (diphenyl phosphate, triphenyl phosphate, tricresyl phosphate, dioctylbutyl phosphate, etc.), a citric ester (e.g., tributyl acetylcitrate), a benzoic ester (e.g., octyl benzoate, etc.), an alkylamide (e.g., diethyllaurylamide, etc.), a fatty acid ester (e.g., dibutoxyethyl succinate, dioctyl azelate, etc.), a trimesic ester (e.g., tributyl trimesate, etc.), etc. or an organic solvent having a boiling point of from about 30° to about 160° C. such as a lower alkyl acetate (e.g., ethyl acetate, butyl acetate, etc.), ethyl propionate, sec-butyl alcohol, methyl isobutyl ketone, $\beta$-ethoxyethyl acetate, methylcellosolve acetate, cyclohexanone or the like, then the resulting solution is dispersed in a hydrophilic colloid. The above-described high-boiling organic solvents and the low-boiling organic solvents may be used in combination.

A method of dispersing the substance using a polymer described in Japanese Patent Publication No. 39,853/76 and U.S. Pat. Nos. 4,512,969, 4,304,769, 4,247,627, 4,214,047, 4,199,363 and 4,203,716 may also be employed. In dispersing the dye-providing substance in a hydrophilic colloid, various surfactants may be used. As such surfactants, those referred to as surfactants later in this specification may be used.

In the present invention, the high-boiling organic solvent is used in an amount of up to 10 g, preferably up to 5 g, per g of the dye-providing substance used.

In the present invention, a reductive substance is desirably incorporated in the light-sensitive material. As such reductive substances, those which are known as reducing agents and the aforementioned reductive dye-providing substances are included. In addition, reducing agent precursors which themselves do not have any reducing ability but can in the developing step, acquire reducing ability by the action of a nucleophilic reagent or heat are also included.

Examples of the reducing agents to be used in the present invention include inorganic reducing agents such as sodium sulfite, sodium hydrogensulfite, etc., benzenesulfinic acids, hydroxylamines, hydrazines, hydrazides, borane amine complexes, hydroquinones, aminophenols, catechols, p-phenylenediamines, 3-pyrazolidinones, hydroxytetrones, ascorbic acid, 4-amino-5-pyrazolones, etc. In addition, reducing agents described in T. H. James; "The theory of the photographic process" 4th. Ed., pp. 291–334 can be uilized as well. Further, reducing agent precursors described in Japanese Patent Application (OPI) Nos. 138,736/81 and 40,245/82, U.S. Pat. No. 4,330,617, etc. can be also utilized.

Combinations of various developing agents as disclosed in U.S. Pat. No. 3,039,369 can be used as well.

In the present invention, the reducing agent is added in an amount of 0.01 to 20 mols, particularly preferably 0.1 to 10 mols, per mol of silver.

In the present invention, an image formation-accelerating agent can be used. The image formation-accelerating agent performs a function of accelerating the oxidation reduction reaction between a silver salt oxidizing agent and a reducing agent, a function of accelerating formation of a dye from a dye-providing substance, decomposition of a dye, or release of a mobile dye, and a function of accelerating migration of a dye from a light-sensitive material layer to a dye-fixing layer, and is classified in view of physical and chemical function, as a base or a base precursor, a nucleophilic compound, an oil, a thermal solvent, a surfactant, a compound performing mutual action with silver or silver ion, or the like. However, the accelerating agents generally possess a plurality of these physical and chemical functions, and usually perform some of the above-described accelerating functions.

The image formation-accelerating agents are classified below according to functions, with each class being specifically exemplified. However, this classification is for convenience and, in fact, one compound often performs a plurality of functions.

(a) Bases

Preferable examples of bases include inorganic bases such as hydroxides, secondary or tertiary phosphates, borates, carbonates, quinolinates, and metaborates of alkali metals or alkaline earth metals, quaternary alkylammonium hydroxides, hydroxides of other metals, etc. and organic bases such as aliphatic amines (trialkylamines, hydroxylamines, aliphatic polyamines, etc.), aromatic amines (e.g., N-alkyl-substituted aromatic amines, N-hydroxyalkyl-substituted aromatic amines, and bis(p-(dialkylamino)phenyl)methanes), heterocyclic amines, amidines, cyclic amidines, guanidines, cyclic guanidines, etc. Those which have a pKa of 8 or above are particularly preferable.

(b) Base precursors

As base precursors, those which undergo some reaction upon being heated to release a base, such as salts between organic acids and bases which are decarboxylated and decomposed by heat, compounds which undergo an intramolecular nucleophilic substitution reaction, a Lossen rearrangement, a Beckmann rearrangement or the like to decompose and release an amine, etc. are preferably used. Preferably examples of the base precursors include salts of trichloroacetic acid described in British Pat. No. 998.949, etc., salts of alphasulfonlacetic acid described in U.S. Pat. No. 4,060,420, salts of propriolic acids described in Japanese Patent Application (OPI) No. 180,573/84, 2-carboxycarboxamide derivatives described in U.S. Pat. No. 4,088,496, thermally decomposable acid salts using as base component alkali metal or alkaline earth metal as well as the organic base (U.S. patent application Ser. No. 601,758 filed on Apr. 19, 1984), hydroxamcarbamates utilizing Lossen rearrangement and described in Japanese Patent Application (OPI) No. 168,440/84, aldoximecarbamates capable of producing a nitrile upon being heated (described in Japanese Patent Appliccation (OPI) No. 157,637/84, etc. In addition, base precursors described in British Pat. No. 998,945, U.S. Pat. No. 3,220,846, Japanese Patent Application (OPI) No. 22,625/75, British Patent No. 2,079,480, etc. are also useful.

(c) Nucleophilic compounds

There are illustrated water and water-releasing compounds, amines, amidines, guanidines, hydroxylamines, hydrazines, hydrazides, oximes, hydroxamic acids, sulfonamides, acitve methylene compounds, alcohols, thiols, etc. Salts or precursors of these compounds can be used as well.

(d) Oil

High-boiling organic solvents (called plasticizers) to be used as solvents upon emulsifying and dispersing hydrophobic compounds can be used.

(e) Thermal solvents

Those which are solid at ambient temperatures and which melt at temperatures around a developing temperature to function as a solvent. Compounds or ureas, urethanes, amides, pyridines, sulfonamides, sulfones, sulfoxides, esters, ketones, and ethers, which is solid at 40° C. or lower, can be used.

(f) Surfactants

There are illustrated pyridinium salts, ammonium salts, and phosphonium salts described in Japanese Patent Application (OPI) No. 74,547/84 and polyalkylene oxides described in Japanese Patent Application (OPI) No. 57,231/84.

(g) Compounds performing mutual action with silver or silver ion

There are illustrated imides, nitorgen-containing heterocyclic compounds described in Japanese Patent Application (OPI) No. 177,550/84, thiols described in Japanese Patent Application (OPI) No. 111,636/84, thioureas, and thioethers.

The image formation-accelerating agent may be incorporated in either of the light-sensitive material and the dye-fixing material, or in both of them. Layers in which the accelerating agent is to be incorporated may be any of an emulsion layer, an interlayer, a protective layer, a dye-fixing layer, and layers contiguous to these layers. The same applies with an embodiment wherein a light-sensitive layer and a dye-fixing layer are provided on the same support.

The image formation-accelerating agents may be used alone or as a combination thereof. In general, however, combined use of several kinds of the agents serves to provide more accelerating effects.

In particular, remarkable accelerating effects are obtained by using the base or base precursor and other accelerating agent in combination.

Of the compounds of the present invention, those which have the compound represented by general formula (II) as PUG exhibit particularly marked effects when a base precursor is used, thus being preferable.

In this case, the ratio of base precursor/compound of the present invention preferably ranges from 1/20 to 20/1, more preferably from 1/5 to 5/1.

In the present invention, those compounds which can both stabilize images and can activate development may be used. Of these, isothiruoniums represented by 2-hydroxyethylisothiuronium trichloroacetate described in U.S. Pat. No. 3,301,678, bis(isothiuronium)s such as 1,8-(3,6-dioxaoctane)bis(isothiuronium thichloroacetate), etc., described in U.S. Pat. No. 3,669,670, thiol compounds described in West German Patent Application (OLS) No. 2,162,714, thiazolium compunds such as 2-amino-2-thiazolium trichloroacetate, 2-amino-5-bromoethyl-2-thiazolium thrchloroacetate, etc., bis(2-amino-2-thiazolium)methylenebis(sulfonylacetate) described in U.S. Pat. No. 4,060,420, 2-amino-2-thiazolium phenylsulfonylacetate, 2-aminothiazolium.2-carboxycarboxamide, etc. are preferably used.

Further, azole thioethers and blocked azoline thione compounds described in Belgian Pat. No. 768,071, 4-aryl-1-carbamyl-2-tetrazoline-5-thione compounds described in U.S. Pat. No. 3,893,859, and compounds described in U.S. Pat. Nos. 3,839,041, 3,844,788, and 3,877,940 are also preferably used.

Binders to be used in the present invention may be incorporated alone or in combination. As the binders, hydrophilic ones may be used. As the hydrophilic binders, transparent or semitransparent hydrophilic binders are typical, and examples thereof include natural materials such as proteins (e.g., gelatin, gelatin derivatives, etc.) and polysaccharides (e.g., cellulose derivatives, starch, gum arabic, etc.), and synthetic polymer substances such as water-soluble polyvinyl compounds (e.g., polyvinylpyrrolidone, acylamide polymer, etc.). Other synthetic polymer susbstances include dispersed vinyl compounds which can enhance particularly dimensional stability of photographic materials in a latex form.

In the present invention, the binder is coated in an amount of not more than 20 g, preferably not more than 10 g, more preferably not more than 7 g, per $m^2$.

As to the ratio of the high-boiling organic solvent to be dispersed in the binder together with the hydrophobic compounds such as the dye-providing substances to the binder, 1 cc or less, preferably 0.5 cc or less, more preferably 0.3 cc or less, of the solvent is suitable per g of the binder.

The photographic light-sensitive material and the dye-fixing material of the present invention may contain an inorganic or organic hardener in a photographic emulsion layer and other binder layer thereof. For example, chromium salts (chromium alum, chromium acetate, etc.), aldehydes (e.g., formaldehyde, glyoxal, glutaraldehyde, etc.), N-methylol compounds (e.g., dimethylolurea, methylol dimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinyl-sulfonyl-2-propanol, 1,2-bis(-vinylsulfonylacetamide)ethane, etc.), active halogen compounds (e.g., 2,4-dichloro-6-hydroxy-s-triazine, etc.), mucohalogenic acids (e.g., (mucochloric acid, mucophenoxychloric acid, etc.), etc. may be used alone or in combination.

The supports to be used in the light-sensitive material of the present invention and the dye-fixing material to be used in some cases are those which can resist processing temperatures. As general supports, not only glasses, papers, metals, and analogues thereof, but acetylcellulose film, cellulose ester film, polyvinyl acetal film, polystyrene film, polycarbonate film, polyethylene terephthalate film, and the films relating to these films or resin materials are used. In addition, paper supports laminated with a polymer such as polyethylene can also be used. Polyesters described in U.S. Pat. Nos. 3,634,089 and 3,725,070 are preferably used.

In the case of using a dye-providing substance capable of imagewise releasing mobile dye, dye migration aids may be used for aiding migration of the dye from a light-sensitive layer to a dye-fixing layer.

As the dye migration aids, water or a basic aqueous solution containing sodium hydroxide, potassium hydroxide or inorganic alkali metal salts are used in the system of supplying the aids from outside. In addition, low-boiling solvents such as methanol, N,N-dimethylformamide, acetone, diisobutylketone, etc., or mixtures of these low-boiling solvents and water or the basic aqueous solution may also be used. The dye migration aids may be used by wetting the image-receiving layer with them.

Incorporation of the dye migration aid in the light-sensitive material or the dye-fixing material eliminates the need for supplying the migration aid from outside. The migration aid may be incorporated in the material as water of crystallization or microcapsules or as a precursor which releases a solvent at elevated temperatures. A more preferable system is to incorporate a hydrophilic thermal solvent which is solid at ordinary temperatures and becomes molten at elevated temperatures in a light-sensitive material or a dye-fixing material. The hydrophilic thermal solvent may be incorporated in either of the light-sensitive material and the dye-fixing material, or in both of them. Layers in which the solvent is to be incorporated may be any of an emulsion layer, an interlayer, a protective layer, and a dye-fixing layer, with the dye-fixing layer and/or the contiguous layer thereof being preferable.

Examples of the hydrophilic thermal solvents include ureas, pyridines, amides, sulfonamides, imides, alcohols, oximes and other heterocyclic compounds.

In order to improve the sharpness of the image, filter dyes, absorbing materials, etc. described in Japanese Patent Publication No. 3,692/73, U.S. Pat. Nos. 3,253,921, 2,527,583, 2,956,879, etc. may be incorporated in the light-sensitive material to be used in the present invention. As such dyes, those which are decolored by heat are preferable. For example, those described in U.S. Pat. Nos. 3,769,019, 3,745,009, 3,615,432, etc. are preferable.

The light-sensitive material to be used in the present invention may contain, if necessary, various additives known for thermally developable light-sensitive materials, and layers other than light-sensitive layers such as antistatic layers, conductive layers, protective layers, interlayer, AH layers, release layers, etc. As the various additives, there are those described in Research Disclosure, vol. 170, June 1978, No. 17029, such as plasticizers, dyes for improving sharpness, AH dyes, sensitizing dyes, matting agents, surfactants, fluorescent brightening agents, anti-discoloration agents, etc.

The photographic element of the present invention is constituted by a light-sensitive element which forms or releases dyes upon thermal development and, if necessary, a dye-fixing element which functions to fix dyes. Particularly in the system of forming an image by diffusion transfer of dyes, both of the light-sensitive element and the dye-fixing element are necessary. Typical embodiments thereof are roughly classified into an embodiment wherein the light-sensitive element and the dye-fixing element are separately provided on two supports, and an embodiment wherein they are provided on the same support.

The former type of embodiments of provding the light-sensitive layer and the dye-fixing layer on different supports are further roughly grouped into two groups: one being of peeling-apart type; and the other being peeling-free type. With the former peeling-apart type, the coated surface of a light-sensitive element is superposed on the coated surface of a dye-fixing element after imagewise exposure or after thermal development and, after formation of the transferred image, the light-sensitive element is immediately peeled apart from the dye-fixing element. As the support of the dye-fixing element, an opaque support or a transparent support can be selected depending upon whether the final image is of reflection type or of transparent type. If necessary, a white reflection layer may be provided. With the latter peeling-free type, a white reflection layer must be provided between the light-sensitive layer of light-sensitive element and the dye-fixing layer of dye-fixing element. This white reflection layer may be provided in either of the light-sensitive element and the dye-fixing element. The support of the dye-fixing element must be transparent.

A typical example of providing the light-sensitive element and the dye-fixing element on the same support is that which does not require peeling apart the light-sensitive element from the image-receiving element after formation of the transferred image. In this case, a light-sensitive layer, a dye-fixing layer, and a white reflection layer are provided in sequence on a transparent or opaque support. As preferable arrangements, there are illustrated for example, transparent or opaque support/light-sensitive layer/white reflection layer/-dye-fixing layer, transparent support/dye-fixing layer/-white reflection layer/light-sensitive layer, etc.

Another typical example of providing the light-sensitive element and the dye-fixing element on the same support is that in which the light-sensitive element is partly or wholly peeled apart from the dye-fixing element, as described in Japanese Patent Application (OPI) No. 67,840/81, Canadian Pat. No. 674,082, and U.S. Pat. No. 3,730,718, with a release layer being provided in the appropriate position.

The light-sensitive element or the dye-fixing element may have a conductive heater layer as heating means for conducting thermal development or diffusion transfer of dyes.

In order to obtain a wide range of colors within the chromaticity diagram using the three primary colors, the light-sensitive element to be used in the present invention must contain at least three silver halide emulsion layers having light sensitivities in different spectrum regions.

As typical combinations of the at least three light-sensitive silver halide emulsion layers having light sensitivity in different spectrum regions, there are a combination of a blue-sensitive emulsion layer, a green-sensitive emulsion layer, and a red-sensitive emulsion layer, a combination of a green-sensitive emulsion layer, a combination of a green-sensitive emulsion layer, a red-sensitive emulsion layer, and an infrared light-sensitive emulsion layer, a combination of a blue-sensitive emulsion layer, a green-sensitive emulsion layer, and an infrared light-sensitive emulsion layer, a combination of a blue-sensitive emulsion layer, a red-sensitive emulsion layer, and an infrared light-sensitive emulsion layer, etc. Additionally, the infrared light-sensitive emulsion layer means an emulsion layer having sensitivity to light of 700 nm or more, particularly 740 nm or more.

The light-sensitive material to be used in the present invention may have, if necessary, two or more layers having light sensitivity in the same spectrum region and having different sensitivities.

Each of the above-described emulsion layers and/or light-insensitive hydrophilic colloidal layers contiguous to each of the emulsion layers must contain one of dye-providing substances which release or form a yellow hydrophilic dye, dye-providing substances which release or form a magenta hydrophilic dye, and dye-providing substances which release or form a cyan hydrophilic dye. In other words, each of the emulsion layer and/or the light-insensitive hydrophilic colloidal layers contiguous to each of the emulsion layers must contain dye-providing substances which release or form hydrophilic dyes of different hues. If desired, a mixture of two or more dye-providing substances having the same hue may be used. Particularly, where the dye-providing substance is colored from the first, it is advantageously incorporated in a layer other than this emulsion layer. In the present invention, the light-sensitive material may have, if necessary, auxiliary layers such as a protective layer, an interlayer, an antistatic layer, a curl-preventing layer, a release layer, a matting agent layer, etc. in addition to the above-described layers.

Particularly, an organic or inorganic matting agent is usually incorporated in the protective layer (PC) for preventing adhesion. This protective layer may contain a mordant, an ultraviolet ray absorbent, etc. The protective layer and the interlayer may be constituted by two or more layers, respectively.

The interlayer may contain a reducing agent for preventing color mixing, an ultraviolet ray absorbent, a white pigment such as titanium dioxide, etc. The white pigment may also be added to not only the interlayer but also the emulsion layer for enhancing sensitivity.

In order to impart the aforesaid color sensitivity to each silver halide emulsion, the emulsion is dye-sensitized with the known sensitizing dyes to acquire the desired spectral sensitivity.

The dye-fixing element to be used in the present invention has at least one mordant-containing layer and, where the dye-fixing layer is positioned on the surface, a protective layer may further be provided, if necessary.

Further, in order to sufficiently incorporate or control the dye migration aid, a water-absorbing layer or a dye migration aid-containing layer may be provided. Such layers may be provided contiguous to the dye-fixing layer or via an interlayer.

The dye-fixing layer to be used in the present invention may, if necessary, be constituted by two or more layers using two or more mordants having different mordanting forces.

In addition to the above-described layers, the dye-fixing materials can have auxiliary layers such as a release layer, a matting agent layer, a curl-preventing layer, etc.

In one or more of the above-described layers may be incorporated a base and/or a base precursor for accelerating the migration of dye, a hydrophilic thermal solvent, an anti-discoloration agent for preventing mixing or dyes, an ultraviolet ray absorbent, a dispersed vinyl compound for increasing dimensional stability, a fluorescent brightening agent, etc.

The binders in the above-described layers are preferably hydrophilic, and transparent or semitransparent hydrophilic colloids are typical. For example, natural materials such as proteins (e.g., gelatin, gelatin derivatives etc.) and polysaccharides (e.g., cellulose derivative, starch, gum arabic, etc.), and synthetic polymer materials such as water-soluble polyvinyl compounds (e.g., dextrin, purian, polyvinyl alcohol, polyvinyl pyrrolidone, acrylamide polymer, etc.) are used. Of these, gelating and polyvinyl alcohol are particularly effective.

The dye-fixing material may contain a reflection layer containing a white pigment such as titanium oxide, a neutralizing layer, a neutralization-timing layer, etc. as the case demands in addition to the above-described layers. These layers may be provided in the light-sensitive element as well as the dye-fixing element. Structures of the above-described reflection layer, neutralizing layer, and neutralization-timing layer are described in, for example, U.S. Pat. Nos. 2,983,606, 3,362,819, 3,362,821, 3,415,644, Canadian Pat. No. 928,559, etc.

Further, the dye-fixing element of the present invention advantageously contains a transfer aid to be described hereinafter. The transfer aid may be incorporated in the above-described dye-fixing layer or in a particularly provided different layer.

In the present invention, a transparent or opaque heating element to be used in the case of employing electric heating as developing means can be prepared by utilizing the conventionally known techniques on resistance heater.

As the resistance heater-preparing process, there is a process of utilizing a thin film of inorganic material showing semiconductivity and a process of utilizing a thin film of organic material comprising conductive fine particles dispersed in a binder. As the materials to be used for the former process, there are silicon carbide, molybdenum silicide, lanthanum chromate, barium titanate ceramics used as a PTC thermistor, tin oxide, zinc oxide, etc., and these can be formed into transparent or opaque thin films according to the known processes. According to the latter process, conductive fine particles such as metal fine particles, carbon black, graphite or the like are dispersed in rubber, synthetic polymer, or gelatin to prepare resistors with the desired temperature characteristics. These resistors may be in direct contact with the light-sensitive element, or may be spaced by a support, an interlayer, etc.

As the image-receiving layer in the present invention, there is the dye-fixing layer used for thermally developable color light-sensitive materials. Mordants therefor can be freely selected from among the usually used mordants, with polymer mordants being particularly preferable. The polymer mordants include polymers having tertiary amino groups, polymers having nitrogen-containing heterocyclic moieties, polymers having quaternary cation groups thereof, etc.

Polymers containing tertiary amino group-having vinyl monomer units are described in Japanese Patent Application (OPI) Nos. 60643/85, 57836/85, etc., and specific examples of polymers having tertiary imidazole group-containing vinyl monomer units are described in Japanese Patent Application Nos. 226,497/83, 232,071/83, U.S. Pat. Nos. 4,282,305, 4,115,124, 3,148,061, etc.

Preferable specific examples of polymers having quaternary imidazolium salt-containing vinyl monomer units are described in British Pat. Nos. 2,056,101, 2,093,041, 1,594,961, U.S. Pat. Nos. 4,124,386, 4,115,124, 4,273,853, 4,450,224, Japanese Patent Application (OPI) No. 28,225/73, etc.

Other preferable specific examples of polymers having quaternary ammonium salt-containing vinyl monomer units are described in U.S. Pat. Nos. 3,709,690, 3,898,088, 3,958,995, Japanese Patent Application (OPI) Nos. 57,836/85 60,643/85, 122,940/85, 122,942/85, Japanese Patent Application No. 91,620/84, etc.

As light sources for imagewise exposing the thermally developable light-sensitive material to record images, radiation including visible lights can be used. In general, various light sources such as a mercury lamp, a halogen lamp (e.g., iodo lamp), xenon lamp, laser beam, CRT light source, fluorescent tube, light-emitting diode (LED), etc. may be used as well as those used for the ordinary color prints such as a tungsten lamp.

The heating temperature in the thermally developing step is as set forth hereinbefore, and temperatures of 140° C. or above, particularly 150° C. or above, are preferable within this range. In the case of conducting the transfer of dye image, image transfer can be conducted by heating to the temperature employed in the thermally developing step to room temperature, with a temperature lower than the temperature in the thermally developing step by about 10° C. being more preferable. As a heating means in the developing step and/or the transferring step, a mere hot plate, an iron, a hot roller, a heater utilizing carbon or titanium white, etc. may be employed.

The dye migration aid (e.g., water) accelerates migration of the image which is provided between the light-sensitive layer of the thermally developable light-sensitive material and the dye-fixing layer of the dye-fixing material. It is also possible to previously impart the dye migration aid to the light-sensitive layer or the dye-fixing layer or both of them, followed by superposing them one on the other.

As the heating means in the transfer step, heating by passing between hot plates or bringing into contact with a hot plate (for example, Japanese Patent Application (OPI) No. 62,635/75), heating by bringing into contact with a rotating hot drum or hot roller (for example, Japanese Patent Publication No. 10,791/68), heating by passing through a hot atmosphere (for example, Japanese Patent Application (OPI) No. 32,737/78), heating by passing through an inert liquid kept at a definite temperature, heating by conveying along a heat source using rollers, belt, or guide member (for example, Japanese Patent Publication No. 2,546/69), etc. may be employed. Alternatively, a layer of a conductive material such as graphite, carbon black, metal, or the like may be superposedly provided on the dye-fixing material, which layer is energized with an electric current to directly heat the material.

The heating temperature to be applied in the aforesaid transfer step can be in the range of from the temperature at the thermally developing step to room temperature, however, the temperature of at least 60° C. and lower than the temperature employed in the thermally developing step by 10° C. or more is particularly preferable.

The present invention is now illustrated in more detail by reference to the following examples which, however, are not to be construed as limiting the preent invention in any way.

EXAMPLE 1

A process for preparing a silver bromoiodide emulsion is described below.

40 g of gelatin and 26 g of KBr were dissolved in 3,000 ml of water. The resulting solution was stirred at 50° C.

Then, a solution of 34 g of silver nitrate dissolved in 200 ml of water was added to the above-described solution in 10 minutes.

Thereafter, a solution of 3.3 g of KI in 100 ml of water was added thereto in 2 minutes.

The pH of the thus prepared silver bromoiodide emulsion was adjusted to cause flocculation, then excess salts were removed.

The pH of the emulsion was then adjusted to 6.0 to obtain 400 g of the silver bromoiodide emulsion.

A process for preparing a benzotriazole silver salt emulsion is described below.

28 g of gelatin and 13.2 g of benzotriazole were dissolved in 3,000 ml of water. This solution was stirred at 40° C. To this solution, a solution of 17 g of silver nitrate in 100 ml of water was added in two minutes.

The pH of this benzotriazole silver salt emulsion was adjusted to flocculate, and excess salts were removed. Then, the pH of the emulsion was adjusted to 6.0 to obtain 400 g of the benzotriazole silver salt emulsion.

A process for preparing a gelatin dispersion of the dye-providing substance (the same as the aforesaid image-forming substance in meaning; hereinafter the same) is described below.

5 g of yellow dye-providing substance (LI-4), 0.5 g of sodium 2-ethylhexyl sulfosuccinate (as a surfactant), 10 g of triisononyl phosphate, and 0.3 g of o-dodecyloxythiophenol were weighed, and 30 ml of ethyl acetate was added thereto, followed by heating to about 60° C. to dissolve. Thus, a uniform solution was obtained. This solution was mixed with 100 g of a 10% solution of lime-processed gelatin under stirring, then the mixture was subjected to dispersing in a homogenizer for 10 minutes at 10,000 rpm. The resulting dispersion was referred to as a dispersion of a yellow dye-providing substance.

A dispersion of a magenta dye-providing substance was prepared in the same manner as described above except for using magenta dye-providing substance (LI-8). Similarly, a dispersion of a cyan dye-providing substance (LI-16) was prepared.

Now, a process for preparing a gelatin dispersion of the compound of the present invention is described below.

3 g of Compound (3) of the present invention was added to 100 g of a 1% gelatin aqueous solution, then milled for 10 minutes in a mill using 100 g of glass beads having an average particle size of about 0.6 mm. After filtering off the glass beads, there was obtained a gelatin dispersion of the compound of the present invention.

A color light-sensitive material of the multi-layered structure shown in the following table was prepared using these dispersions.

| Light-sensitive material A | |
|---|---|
| Sixth layer | Gelatin (coated amount: 1000 mg/m$^2$)<br>Base precursor*3 shown below (coated amount: 220 mg/m$^2$)<br>Compound (3) of the present invention (coated amount: 10 mg/m$^2$) |
| Fifth layer | Blue-sensitive emulsion layer—<br>AgBrI emulsion (iodide: 10 mol %; coated amount: 400 mg of silver/m$^2$)<br>Compound*4 shown below (coated amount: 180 mg/m$^2$)<br>Base precursor*3 shown below (coated amount: 520 mg/m$^2$)<br>Compound (3) of the present invention (coated amount: 5 mg/m$^2$)<br>Yellow dye-providing substance (LI-4) (coated amount: 400 mg/m$^2$)<br>Gelatin (coated amount: 1000 mg/m$^2$)<br>High-boiling solvent*1 (coated amount: 800 mg/m$^2$)<br>Surfactant*2 (coated amount: 100 mg/m$^2$)<br>Compound*5 shown below (coated amount: 29 mg/m$^2$) |
| Fourth layer | Interlayer—<br>Gelatin (coated amount: 1200 mg/m$^2$)<br>Base precursor*3 shown below (coated amount: (220 mg/m$^2$)<br>Compound (3) of the present invention (coated amount: 10 mg/m$^2$) |
| Third layer | Green-sensitive emulsion layer— |

-continued

| Light-sensitive material A | |
|---|---|
| | AgBrI emulsion (iodide: 10 mol %; coated amount: 400 mg of Ag/m$^2$)<br>Compound*4 shown below (coated amount: 180 mg/m$^2$)<br>Sensitizing dye (D-1) (coated amount: $10^{-6}$ mol/m$^2$)<br>Base precursor*3 shown below (coated amount: 515 mg/m$^2$)<br>Compound (3) of the present invention (coated amount: 5 mg/m$^2$)<br>Magenta dye-providing substance (LI-8) (coated amount: 400 mg/m$^2$)<br>Gelatin (coated amount: 1000 mg/m$^2$)<br>High-boiling solvent*1 (coated amount: 800 mg/m$^2$)<br>Surfactant*2 (coated amount: 100 mg/m$^2$)<br>Compound*5 shown below (coated amount: 24 mg/m$^2$) |
| Second layer | Interlayer—<br>Gelatin (coated amount: 1000 mg/m$^2$)<br>Base precursor*3 shown below (coated amount: 230 mg/m$^2$)<br>Compound (3) of the present invention (coated amount: 10 mg/m$^2$) |
| First layer | Red-sensitive emulsion layer—<br>AgBrI emulsion (iodide: 10 mol %; coated amount: 400 mg of Ag/m$^2$)<br>Compound*4 shown below (coated amount: 180 mg/m$^2$)<br>Sensitizing dye (D-2) (coated amount: $8 \times 10^{-7}$ mol/m$^2$)<br>Base precursor*3 shown below (coated amount: 515 mg/m$^2$)<br>Compound (LI-16) of the present invention (coated amount: 5 mg/m$^2$)<br>Cyan dye-providing substance (3) (coated amount: 300 mg/m$^2$)<br>Gelatin (coated amount: 1000 mg/m$^2$)<br>High-boiling solvent*1 (coated amount: 600 mg/m$^2$)<br>Surfactant*2 (coated amount: 100 mg/m$^2$)<br>Compound*5 shown below (coated amount: |

-continued

| Light-sensitive material A |
|---|
| 18 mg/m$^2$) |

Support

*1 (iso-$C_9H_{19}O)_3P{=}O$

*2 $C_9H_{19}$—⟨benzene⟩—$O(CH_2CH_2O)_8H$

*3 $CH_3CONH$—⟨benzene⟩—$C{\equiv}CCOOH.HN{=}(NH_2)_2$

*4 ⟨benzene⟩($SO_2NH_2$, $H_3CO_2C$, $CO_2CH_3$)

*5 ⟨benzene⟩($OC_{12}H_{25}$, SH)

D-1

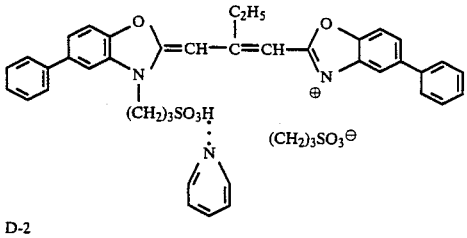

D-2

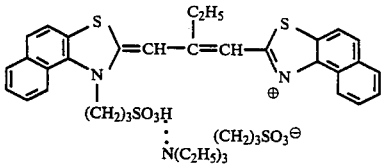

Then, Light-sensitive materials B and C were prepared according to the same formulation as described above except for using Compounds (10) and (17) of the present invention, respectively, in place of Compound (3) of the present invention in Light-sensitive material A. In addition, Light-sensitive material D not containing the compound of the present invention was also prepared in the same manner for comparison.

A process for forming an image-receiving material having an image-receiving layer is described below.

First, 0.75 g of gelatin hardner H-1, 0.25 g of H-2, 160 ml of water, and 100 g of 10% lime-processed gelatin were uniformly mixed. This mixture was uniformly coated in a wet thickness of 60 μm on a paper support laminated with polyethylene containing titanium oxide, dispersed therein, then dried.

Gelatin hardener H-1

$CH_2{=}CHSO_2CH_2CONHCH_2CH_2NHCOCH_2.$
$.SO_2CH{=}CH_2$

Gelatin hardener H-2

$CH_2{=}CHSO_2CH_2CONHCH_2.CH_2CH_2NHCOCH-$
$_2SO_2CH{=}CH_2$

Then, 15 g of a polymer of the following structure was dissolved in 200 ml of water, and uniformly mixed with 100 g of 10% lime-processed gelatin. This mixture was uniformly coated in a wet thickness of 85 μm on the above-described coating. This sample was dried to prepare a dye-fixing material.

Polymer

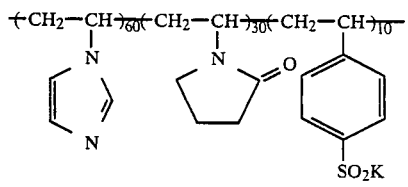

(limiting viscosity: 0.3473 measured in a 1/20M $Na_2HPO_4$ aqueous solution at 30° C.)

Each of the above-described multi-layered color light-sensitive materials was exposed for 10 seconds at 2000 lx using a tungsten bulb through a three-color filter of B, G, and R wherein densities thereof were continuously changed, then uniformly heated for 20 seconds on a heat block heated to 150° C. or 153° C.

After dipping the image-receiving material, each of the above-described heated Light-sensitive materials A to D was superposed thereon with the coated surfaces facing each other.

Then, each assembly was heated for 6 seconds on a 80° C. heat block. When the image-receiving material was peeled apart from the light-sensitive material, a negative magenta image was obtained on the image-receiving materials. Densities of the negative images were measured using a Macbeth reflection densitometer (RD-519) to obtain the following results.

| Sample | Compound No. of the present invention | Filter | Heating at 150° C. for 20 sec. Dmax | Heating at 150° C. for 20 sec. Dmin | Heating at 153° C. for 20 sec. Dmax | Heating at 153° C. for 20 sec. Dmin |
|---|---|---|---|---|---|---|
| A | (3) | B | 1.98 | 0.17 | 2.00 | 0.19 |
| | | G | 2.05 | 0.18 | 2.09 | 0.23 |
| | | R | 2.10 | 0.17 | 2.13 | 0.19 |
| B | (10) | B | 1.91 | 0.18 | 1.92 | 0.20 |
| | | G | 2.00 | 0.15 | 2.03 | 0.19 |
| | | R | 2.07 | 0.15 | 2.08 | 0.18 |
| C | (17) | B | 1.87 | 0.14 | 1.90 | 0.16 |
| | | G | 1.95 | 0.15 | 1.97 | 0.17 |
| | | R | 2.06 | 0.14 | 2.06 | 0.17 |
| D (comparison) | no | B | 1.95 | 0.18 | 2.03 | 0.31 |
| | | G | 2.04 | 0.20 | 2.16 | 0.41 |
| | | R | 2.12 | 0.17 | 2.30 | 0.29 |

It is seen from the above results that, with samples containing the compounds of the present invention, there resulted less increase in both maximum and minimum densities when developing temperature was raised by 3° C., whereas the comparative sample not containing the compounds of the present invention underwent a serious increase in fog. Thus, the compounds of the present invention are demonstrated to possess a high temperature-conpensating effect.

EXAMPLE 2

A silver halide emulsion for the 5th layer was prepared as follows.

1000 ml of an aqueous solution containing potassium oidide and potassium bromide and a silver nitrate aqueous solution (prepared by dissolving 1 mol of silver nitrate in 1000 ml of water) were simultaneously added to a well stirred gelatin aqueous solution (prepared by dissolving 20 g of gelatin and ammonia in 1000 cc of water, and kept at 50° C.), keeping the pAg at a constant level to prepare a mono-disperse silver bromoiodide octahedral emulsion (iodide content: 5 mol %).

After washing with water and removal of salts, 5 mg of cholorauric acid (4 hydrate) and 2 mg of sodium thiosulfate were added to the emulsion to conduct gold and sulfur sensitization at 60° C. Thus, 1.0 kg of the emulsion was obtained.

Then, an emulsion for the 3rd layer was prepared as follows.

600 ml of an aqueous solution containing sodium chloride and potassium bromide, a silver nitrate aqueous solution (prepared by dissolving 0.59 mol of silver nitrate in 600 ml of water), and a solution of the following dye (I) were simultaneously added in equal droplets in 40 minutes to a well stirred gelatin aqueous solution (containing 20 g of gelatin and 3 g of sodium chloride in 1000 ml of water and kept at 75° C.) to prepare a mono-disperse cubic silver chlorobromide emulsion (bromide content: 80 mol %) containing grains of 0.35μ in average grain size and absorbing the dye.

After washing with water and removal of salts, 5 mg of sodium thiosulfate and 20 mg of 4-hydroxy-6-methyl-1,3,3a,7-tetrazaindene were added to the emulsion to conduct chemical sensitization at 60° C. Thus, 600 g of the emulsion was obtained.

Dye solution (I)

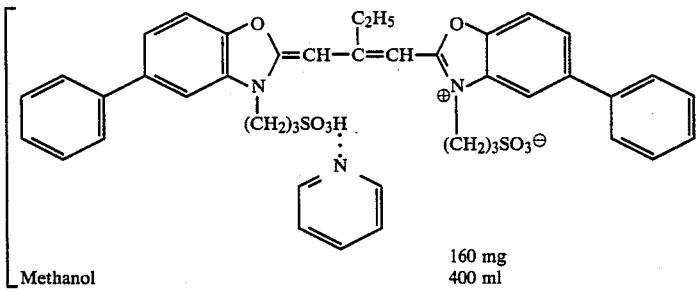

An emulsion for the first layer was prepared as follows.

600 mg of an aqueous solution containing sodium chloride and potassium bromide and a silver nitrate aqueous solution (prepared by dissolving 0.59 mol of silver nitrate in 600 ml of water) were simultaneously added in equal droplets to a well stirred gelatin aqueous solution (containing 20 g of gelatin and 3 g of sodium chloride in 1000 ml of water, and kept at 75° C.) in 40 minutes. Thus, a mono-disperse cubic silver chlorobromide emulsion (bromide: 80 mol %) of 0.35μ in mean grain size was prepared.

After washing with water and removal of salts, 5 mg of sodium thiosulfate and 20 mg of 4-hydroxy-6methyl-1,3,3a,7-tetrazaindene were added to the emulsion to conduct chemical sensitization at 60° C. Thus, 600 g of an emulsion was obtained.

A bẽnzotrizole silver salt emulsion was prepared in the same manner as in Example 1.

| Light-sensitive material E | |
|---|---|
| Sixth layer | Gelatin (coated amount: 740 mg/m$^2$) |
| | Base precursor (A)*3 (coated amount: 250 mg/m$^2$) |
| Fifth layer | Blue-sensitive emulsion layer |
| | AgBrI emulsion (iodide: 5 mol %; coated amount: 500 mg of Ag/m$^2$) |
| | Benzenesulfamide (coated amount: 160 mg/m$^2$) |
| | Base precursor (A)*3 (coated amount: 270 mg/m$^2$) |
| | Benzotriazole silver salt emulsion (coated amount: 300 mg of Ag/m$^2$) |
| | Yellow dye-providing substance (LI-4) (coated amount: 400 mg/m$^2$) |
| | Gelatin (coated amount: 1200 mg/m$^2$) |
| | High-boiling solvent*1 (coated amount: 700 mg/m$^2$) |
| | Surfactant*2 (coated amount: 70 mg/m$^2$) |
| Fourth layer | Interlayer |
| | Gelatin (coated amount: 700 mg/m$^2$) |
| | Base precursor (A) (240 mg/m$^2$) |
| Third layer | Green-sensitive emulsion layer |
| | AgClBr emulsion (bromide: 80 mol %; coated amount: 200 mg/m$^2$) |
| | Benzenesulfamide (coated amount: 140 mg/m$^2$) |
| | Benzotriazole silver salt emulsion (coated amount: 100 mg of Ag/m$^2$) |
| | Base precursor (A)*3 (210 mg/m$^2$) |
| | Magenta dye-providing substance (LI-8) (coated amount: 330 mg/m$^2$) |
| | Gelatin (coated amount: 360 mg/m$^2$) |
| | High-boiling solvent*1 (coated amount: 430 mg/m$^2$) |
| | Surfactant*2 (coated amount: 60 mg/m$^2$) |
| Second layer | Interlayer |
| | Gelatin (coated amount: 1000 mg/m$^2$) |
| | Base precursor (A)*3 (coated amount: 240 mg/m$^2$) |
| First layer | Red-sensitive emulsion layer |
| | AgClBr emulsion (bromide: 80 mol %; coated amount: 200 mg of Ag/m$^2$) |
| | Benzenesulfamide (coated amount: 140 mg/m$^2$) |
| | Sensitizing dye*4 (coated amount: $8 \times 10^{-7}$ mol/m$^2$) |
| | Benzotriazole silver salt emulsion (230 mg/m$^2$) |
| | Base precursor (A)*3 (230 mg/m$^2$) |
| | Cyan dye-providing substance (LI-16) (coated amount: 300 mg/m$^2$) |
| | Gelatin (coated amount: 850 mg/m$^2$) |
| | High-boiling solvent*1 (coated amount: 540 mg/m$^2$) |
| | Surfactant*3 (coated amount: 60 mg/m$^2$) |
| SUPPORT | |

*1: (iso-$C_9H_{19}O)_3P{=}O$

*2:

-continued

Light-sensitive material E

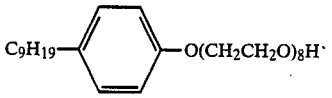

*3: Base precursor (A)

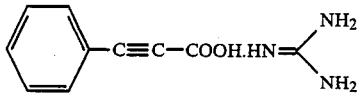

*4:

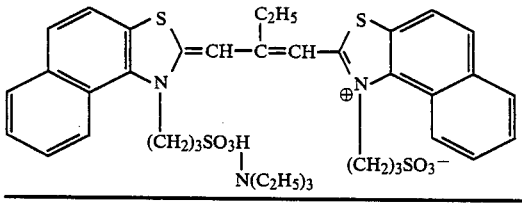

A dye-fixing material was prepared as follows.

12 g of lime-processed gelatin was dissolved in 200 ml of water, and 16 mol of a 0.5M zinc acetate aqueous solution was added thereto, followed by mixing the solution to prepare a uniform solution. This mixed solution was uniformly coated in a wet thickness of 85 μm on a 100 μm thick white film support consisting of polyethyleneterephthalate containing titanium dioxide. Then, a coating solution of the following formulation was uniformly coated thereon in a wet thickness of 90 μm and dried to prepare the dye-fixing material.

| Formulation of coating solution for forming dye-fixing layer F: | |
|---|---|
| 10% Aqueous solution of polyvinyl alcohol (polymerization degree: 2000) | 120 g |
| Urea | 20 g |
| N—Methylurea | 20 g |
| 12% Aqueous solution of 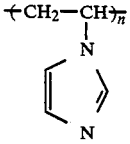 (limiting viscosity: 0.1726, measured in a 1% NaCl aqueous solution at 30° C.) | 80 g |
| Compound (3) of the present invention (described in Example 1) | 60 ml |

| Formulation of coating solution for forming dye-fixing layer G: | |
|---|---|
| 10% Aqueous solution of polyvinyl alcohol (polymerization degree: 2000) | 120 g |
| Urea | 20 g |
| N—Methylurea | 20 g |
| 12% Aqueous solution of 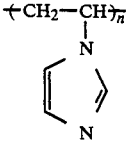 (same as is described above) | 80 g |
| Water | 60 ml |

Each of the above-described multi-layered color light-sensitive materials was exposed for 1 second at 2,000 lx using a tungsten bulb through a three-color filter of B, G, and R wherein the densities thereof were continuously changed, then uniformly heated for 30 seconds on a heat block heated to 140° C.

Each of the light-sensitive materials was superposed on the formerly prepared dye-fixing material with the coated surfaces facing each other, and the assembly was passed between 130° C., pressured rollers and immediately heated for 30 seconds at 120° C. on a heat block. After heating, the dye-fixing material was immediately peeled apart from the light-sensitive material to obtain yellow, magenta, and cyan color images on the dye-fixing materials corresponding to the three color filters B, G, and R. Maximum and minimum densities of the respective colors were measured using a Macbeth reflection type densitometer (RD-519). Results thus obtained are tabulated below.

| Color Separation Filter | Using Dye-fixing Layer F (present invention) Dmax | Dmin | Using Dye-fixing Layer G (comparison) Dmax | Dmin |
|---|---|---|---|---|
| B | 1.88 | 0.20 | 1.90 | 0.28 |
| G | 2.12 | 0.28 | 2.12 | 0.32 |
| R | 2.21 | 0.22 | 2.25 | 0.29 |

As is described above, it is seen that, when added to a dye-fixing layer, the compound of the present invention has the effect of depression fog in the transfer step.

EXAMPLE 3

10 g of dye-providing substance (LI-17), 0.5 g of sodium 2-ethylhexyl sulfosuccinate, and 10 g of tricresyl phosphate were weighed, and 20 ml of cyclohexanone was added thereto, followed by heating to 60° C. to prepare a uniform solution. This solution was mixed with 100 g of a 10% aqueous solution of lime-processes gelatin, then emulsified and dispersed in a homogenizer.

Light-sensitive material H was prepared as follows.

| | | |
|---|---|---|
| (a) | Silver bromoiodide emulsion of Example 1 | 5.5 g |
| (b) | 10% Gelatin aqueous solution | 0.5 g |
| (c) | Dispersion of the above-described dye-providing substance | 2.5 g |
| (d) | 10% Ethanol solution of guanidine trichloroacetate | 1 ml |
| (e) | 10% Methanol solution of 2.6-dichloro-4-aminophenol | 0.5 ml |
| (f) | 5% of Aqueous solution of the compound of the following structure; 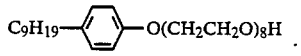 | 1 ml |
| (g) | Gelatin dispersion of Compound (3) of the present invention | 0.5 ml |
| (h) | Water | 6 ml |
| (LI-17) | 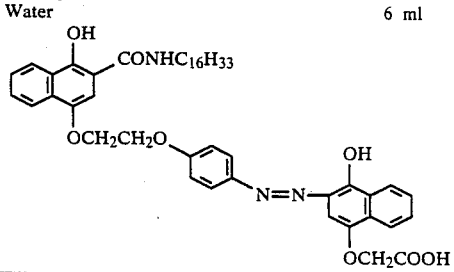 | |

The above-described components (a) to (h) were mixed and heated to dissolve, then coated in a wet thickness of 85 μm on a polyethylene terephthalate film. Gelatin was further coated on this film as a protective layer in an amount of 1.5 g/m$^2$ to prepare Light-sensitive material H.

This Light-sensitive material H was imagewise exposed for 10 seconds at 2,000 lx using a tungsten bulb, then uniformly heated for 30 seconds on a heat block heated to 140° C. or 143° C.

Then, the light-sensitive material was processed in the same manner as in Example 1 to obtain the following results.

| | Heating at 140° C. for 30 sec. | | Heating at 143° C. for 30 sec. | |
|---|---|---|---|---|
| Sample | Dmax | Dmin | Dmax | Dmin |
| H | 2.03 | 0.18 | 2.06 | 0.19 |

It is seen from the above table that the compound of the present invention shows remarkable effects in the light-sensitive material containing a dye-providing substance which release a dye as a result of a coupling reaction with an oxidation product of a developing agent.

EXAMPLE 4

20 ml of cyclohexanone was added to a mixture of 5 g of dye-providing substance (LI-18) having the following structure, 4 g of an electron donor having the following structure, 0.5 g of sodium 2-ethylhexyl sulfosuccinate, and 10 g of tricresyl phosphate, and the resulting mixture was heated to about 60° C. to dissolve. Subsequent procedures were conducted in the same manner as in Example 3 to prepare a dispersion of reducible dye-providing substance.

(LI-18)

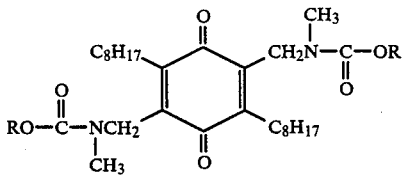

R:

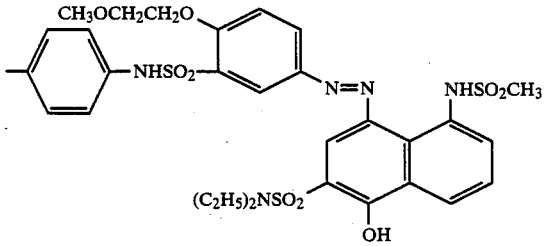

Electron donor:

-continued

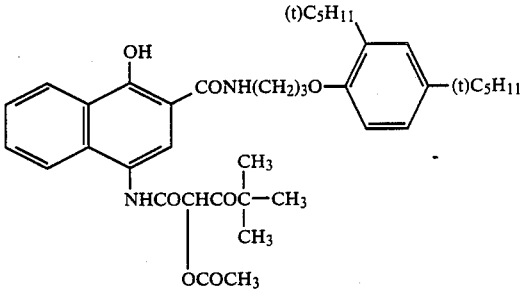

Light-sensitive material I was prepared in the same manner as with Light-sensitive material H in Example 3 except for using the above-described dispersion of reducible dye-providing substance in place of the dispersion of dye-providing substance (1).

This Light-sensitive material I was exposed and processed in the same manner as in Example 3, and densities were measured to obtain the following results.

| | Heating at 140° C. for 30 sec. | | Heating at 143° C. for 30 sec. | |
|---|---|---|---|---|
| Sample | Dmax | Dmin | Dmax | Dmin |
| I | 1.79 | 0.19 | 1.83 | 0.23 |

It is confirmed from the above results that the compound of the present invention is also effective in the light-sensitive material containing the reducible dye-providing substance capable of forming a positive image in conformity with a silver image.

EXAMPLE 5

Preparation of a coupler gelatin dispersion 5 g of 2-dodecylcarbamoyl-1-naphthol, 0.5 g of sodium 2-ethylhexyl sulfosuccinate, and 2.5 g of tricresyl phosphate (TCP) were weighed, and 30 ml of ethyl acetate was added thereto to dissolve. This solution was mixed with 100 g of a 10% gelatin solution, then dispersed for 10 minutes in a homogenizer at 10,000 rpm.

Light-sensitive material J was prepared as follows.

| | | |
|---|---|---|
| (a) | Silver bromoiodide emulsion (described in Example 1) | 10 g |
| (b) | Gelatin dispersion of coupler | 3.5 g |
| (c) | Solution of 0.25 g of guanidine trichloroacetate in 2.5 cc of ethanol | |
| (d) | Gelatin (10% aqueous solution) | 5 g |
| (e) | Solution of 0.2 g of 2,6-dichloro-p-aminophenol in 15 cc of water | |
| (f) | Gelatin dispersion of Compound (3) of the present invention (described in Example 1) | 1 ml |

A coating solution of the above-described formulation was coated in a wet thickness of 60 μm on a polyethylene terephthalate support, then dried to prepare a light-sensitive material.

This light-sensitive material was imagewise exposed for 5 seconds at 2000 lx using a tungsten bulb. Then, it was uniformly heated for 20 seconds on a heat block heated to 150° C. or 153° C. to obtain a negative cyan color image. The densities of the image were measured using a Macbeth transparent densitometer (TD-504) to obtain the following results.

| Sample | Heating at 150° C. for 20 sec. Dmax | Dmin | Heating at 153° C. for 20 sec. Dmax | Dmin |
|---|---|---|---|---|
| J | 2.14 | 0.24 | 2.16 | 0.27 |

It is seen from the above results that the compound of the present invention has a high temperature-compensating effect.

EXAMPLE 6

A black-and-white example is described below.

Light-sensitive material K was prepared as follows.

| | |
|---|---|
| (a) Silver bromoiodide emulsion (described in Ex. 1) | 1 g |
| (b) Benzotriazole silver salt emulsion (described in Example 1) | 10 g |
| (c) 10% Ethanol solution of guanidine trichloroacetate | 1 cc |
| (d) 5% Methanol solution of the compound of the following structure: 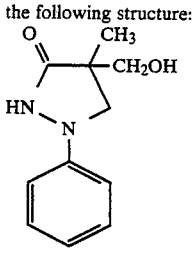 | 2 cc |
| (e) Gelatin dispersion of Compound (3) of the present invention (described in Example 1) | 1 cc |

A coating solution of the above-described formulation was coated in a wet thickness of 60 μm on a polyethylene terephthalate support.

This light-sensitive material was imagewise exposed for 5 seconds at 2000 lx using a tungsten bulb. Then, it was uniformly heated for 30 seconds on a heat block heated to 130° C. or 133° C. to obtain negative brown images. The densities of the images were measured using a Macbeth transparent densitometer (TD-504) to obtain the following results.

| Sample | Heating at 130° C. for 30 sec. Dmax | Dmin | Heating at 133° C. for 30 sec. Dmax | Dmin |
|---|---|---|---|---|
| K | 0.85 | 0.13 | 0.88 | 0.15 |

Thus, the compound of the present invention is demonstrated to exhibit high temperature-compensating effect.

While the present invention has been described in detail and with reference to specific embodiments thereof, it is apparent to one skilled in the art that various changes and modifications can be made therein without departing from the spirit and the scope of the present invention.

What is claimed is:

1. An image-forming process involving a heating step which comprises heating, in the presence of a nucleophilic agent, a heat-developable light-sensitive material after or simultaneously with imagewise exposure thereof, said light-sensitive material comprising silver halide, and a compound represented by the following general formula (I):

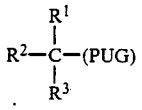

(I)

wherein:

$R^1$ and $R^2$, which may be the same or different, each represents a group selected from an aryl group, a substituted aryl group, a heterocyclic group, a substituted heterocyclic group, and a fused ring thereof wherein the substituent on the substituted aryl group or the substituted heterocyclic group is selected from the group consisting of a substituted or unsubstituted alkyl group, a substituted or unsubstituted alkoxy group, a substituted or unsubstituted aryl group, a halogen atom, a cyano group, a nitro group, an alkyl- or arylthio group, and an alkyl-or arylsulfonyl group, a substituted or unsubstituted carbamoyl group, a substituted or unsubstituted sulfamoyl group, an amino group, a carboxy group, a sulfo group, an alkyl- or aryloxycarbonyl group;

$R^3$ represents a hydrogen atom, an alkyl group, a substituted alkyl group, a cycloalkyl group, a substituted cycloalkyl group, an aralkyl group, a substituted aralkyl group, or a group selected from those which are referred to with respect to $R^1$ and $R^2$;

$R^1$, $R^2$, and $R^3$ may form a ring structure via a hydrocarbon chain, a hetero atom-containing hydrocarbon chain or a hetero atom, or may be directly bonded to each other to form a ring structure; and PUG represents a photographically useful group represented by the following general formula (II):

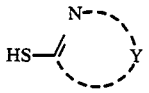

(II)

wherein Y represents atoms necessary for forming a 5- or 6-membered heterocyclic ring; wherein the compound of general formula (I) is bound to the compound of general formula (II) via the sulfur or nitrogen atom or the compound of general formula (II).

2. The image-forming process involving a heating step as claimed in claim 1, wherein $R^1$ and $R^2$, which may be the same or different, each represents a group selected from an aryl group having 6 to 18 carbon atoms; a substituted aryl group consisting of said aryl group and said substituent; a 5-, 6- or 7-membered heterocyclic group containing at least one or an oxygen atom, a nitrogen atom and a sulfur atom; a substituted heterocyclic group consisting of said 5-, 6- or 7-membered heterocyclic group and substituent; and a fused ring thereof.

3. The image-forming process involving a heating step as claimed in claim 1, wherein $R^3$ represents a group selected from a linear- or branched-chain alkyl group having 1 to 18 carbon atoms; a substituted alkyl group consisting of said linear- or branched-chain alkyl group and a substituent; a 5- or 6-membered cycloalkyl group having 5 to 10 carbon atoms; and a substituted cycloalkyl group consisting of said 5- or 6-membered cycloalkyl group and a substituent.

4. The image-forming process involving a heating step as claimed in claim 1, wherein $R^3$ represents a group selected from an aryl group having 6 to 18 carbon atoms; a substituted aryl group consisting of said aryl group and a substituent; a 5-, 6- or 7-membered heterocyclic group containing at least one of an oxygen atom, a nitrogen atom and a sulfur atom; a substituted heterocyclic group consisting of said 5-, 6- or 7-membered heterocyclic group and a substituent; and a fused ring thereof.

5. The image-forming process involving a heating step as claimed in claim 1, wherein Y represents atoms necessary for forming a 5- or 6-membered heterocyclic ring containing a sulfur atom, a nitrogen atom or an oxygen atom within the ring.

6. The image-forming process involving a heating step as claimed in claim 1, wherein the compound represented by the general formula (I) is used in an amount of not more than 50 wt % based on the weight of the coated film.

7. The image-forming process involving a heating step as claimed in claim 6, wherein the compound represented by the general formula (I) is used in an amount of not more than 30 wt % based on the weight of the coated film.

8. The image-forming process involving a heating step as claimed in claim 1, wherein the silver halide has an average grain size of 0.001 to 10 μm.

9. The image-forming process involving a heating step as claimed in claim 8, wherein the silver halide has an average grain size of 0.001 to 5 μm.

10. The image-forming process involving a heating step as claimed in claim 1, wherein the heating temperature is about 50° to 250° C.

11. The image-forming process involving a heating step as claimed in claim 10, wherein the heating temperature is 60° to 180° C.

12. The image-forming process involving a heating step as claimed in claim 1, wherein at least two of $R^1$, $R^2$ and $R^3$ are aryl groups, substituted aryl groups, heterocyclic groups, or substituted heterocyclic groups.

* * * * *